US005242789A

United States Patent [19]

Sato et al.

[11] Patent Number: 5,242,789

[45] Date of Patent: * Sep. 7, 1993

[54] PROCESS FOR FORMING COLOR IMAGE

[75] Inventors: Tadahisa Sato; Nobuo Furutachi, both of Kanagawa, Japan

[73] Assignee: Fuji Photo Film Co., Ltd., Kanagawa, Japan

[ * ] Notice: The portion of the term of this patent subsequent to Aug. 15, 2006 has been disclaimed.

[21] Appl. No.: 542,480

[22] Filed: Jun. 22, 1990

Related U.S. Application Data

[63] Continuation-in-part of Ser. No. 934,875, Nov. 25, 1986, abandoned.

[30] Foreign Application Priority Data

Nov. 25, 1985 [JP] Japan ..... 60-264125
Oct. 13, 1986 [JP] Japan ..... 61-242712

[51] Int. Cl.[5] ..... G03C 7/32

[52] U.S. Cl. ..... 430/558; 430/551; 430/386; 430/387

[58] Field of Search ..... 430/387, 386, 558, 551

[56] References Cited

U.S. PATENT DOCUMENTS

| | | | |
|---|---|---|---|
| 4,559,297 | 12/1985 | Seto et al. | 430/551 |
| 4,588,679 | 5/1986 | Furutachi | 430/551 |
| 4,735,893 | 4/1988 | Morigaki et al. | 430/551 |
| 4,857,444 | 8/1989 | Hirose et al. | 430/505 |
| 4,892,809 | 1/1990 | Momoki | 430/550 |

*Primary Examiner*—Charles L. Bowers, Jr.
*Assistant Examiner*—Thorl Chea
*Attorney, Agent, or Firm*—Sughrue, Mion, Zinn, Macpeak & Seas

[57] ABSTRACT

A silver halide photographic material comprising a support having thereon a silver halide emulsion layer containing at least one coupler represented by the following formulae (I) and (II):

(I)

(II)

wherein $R_1$ represents an alkyl group, an aryl group or a heterocyclic group; $R_2$ or $R'_2$ represents an alkyl group, an aryl group; and X represents a coupling split-off group liked through a nitrogen or a sulfur atom.

6 Claims, No Drawings

PROCESS FOR FORMING COLOR IMAGE

CROSS REFERENCE TO RELATED APPLICATION

This is a continuation-in-part application of Ser. No. 06/934,875, filed Nov. 25, 1986, now abandoned.

FIELD OF THE INVENTION

The present invention relates to a method for processing a silver halide color photographic material and, more particularly, to a method for processing a silver halide color photographic material, which can increase photographic speed, improve gradation (gamma), heighten color density of the developed image, and improve resistance to yellow stain formation due to heat. More specifically, it is concerned with a process for forming color image, which comprises developing a silver halide color photographic material using a developer containing an aromatic primary amine in the presence of a magenta coupler of the 1H pyrazolo[1,5-b]-1,2,4-triazole or 1H-pyrazolo[5,1-c]-1,2,4-triazole type which is characterized by having a substituted or unsubstituted alkyloxy, aryloxy, or heterocyclic oxy group at the 6-position.

BACKGROUND OF THE INVENTION

It is well known that color developing agents of the aromatic primary amine type which have been oxidized with exposed silver halides as oxidants react with couplers to produce indophenol, indoaniline, indamine, azomethine, phenoxazine, phenazine and their analogous dyes, thus forming color images.

Of the color images, a magenta color image is formed by using couplers of a 5-pyrazolone, cyanoacetophenone, indazolone, pyrazolobenzimidazole or pyrazolotriazole type.

Most of the magenta color image-forming couplers which have so far been used widely and studies of which have been proceeded are 5-pyrazolones. However, it is known that the dyes formed from 5-pyrazolone couplers have an unnecessary absorption containing a yellow component in the neighborhood of 430 nm to cause color turbidity.

As magenta color image forming nuclei which enable reduction of this yellow component, there have been proposed pyrazolobenzimidazole nuclei in British Patent 1,047,612, indazolone nuclei in U.S. Pat. No. 3,770,447, and pyrazolo[5,1-b]-1,2,4-triazole nuclei in U.S. Pat. No. 3,725,067.

However, the magenta couplers described in the foregoing patent specifications also have such undesirable properties that when mixed with a silver halide emulsion in a condition that they are dispersed in a hydrophilic protective colloid like gelatin, some of them provide only unsatisfactory color images, some of them have low solubility in high boiling organic solvents, some of them are difficult to synthesize, some of them have relatively low coupling activity in an ordinary developer, and that some of them provide dyes of extremely poor fastness to light.

As a result of various searches for new type magenta color image-forming couplers having no side absorption at wavelengths around 430 nm, which is the most serious defect of 5-pyrazolone couplers in respect to hue, some of the present inventors found 1H-pyrazolo[1,5-b]-1,2,4-triazole magenta couples which show no side absorption in the shorter wavelength side, produce dye image of high fastness and can be synthesized with ease as disclosed in JP-A-59-171956 (the term "JP-A" as used herein means an "unexamined published Japanese patent application") and U.S. Pat. No. 4,540,654. These couplers have advantages in that they are excellent in color reproducibility, can be synthesized with ease, and can be readily converted to so-called two-equivalent couplers by introducing a split-off group to a coupling active site, thus achieving reduction of the amount of silver to be used. However, when a coupling split-off group (X) is such a group as to give facility in synthesizing the resulting coupler, e.g., a halogen atom, an alkylthio group, an arylthio group, etc., there arises a problem that such couplers are somewhat inferior to 5-pyrazolone magenta couplers in respect to sensitivity and gradation (gamma). Thereupon, it has been found that couplers having an aryloxy group as a coupling split-off group can afford a means for solving the above-described problem. However, the aryloxy group-releasing couplers suffer from disadvantages that they are obtained in such a low yield as to be unsuitable for large-scaled synthesis and that they have low stability. Also, pyrazoloazoles described in the above-cited U.S. Pat. No. 3,725,067 have similar defects.

SUMMARY OF THE INVENTION

Therefore, a primary object of the present invention is to solve the above-described problems and to provide a magenta coupler having higher sensitivity and improved gradation (gamma).

Another object of the invention is to provide an improvement in resistance to yellow stain formation due to heat.

The above-described objects are attained with a process for forming color image, which comprises developing a silver halide photographic material using a developer containing an aromatic primary amine in the presence of at least one of couplers represented by the following formulae (I) and (II):

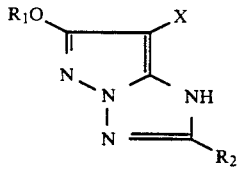

(I)

wherein $R_1$ represents an alkyl group, an aryl group, or a heterocyclic group; $R_2$ represents a hydrogen atom or a substituent group; and X represents a hydrogen atom or a coupling split-off group:

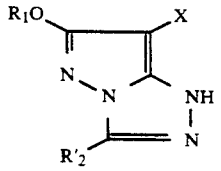

(II)

wherein $R_1$ and X have the same meanings as in the formula (I), respectively; and $R'_2$ represents an alkyl group or an aryl group, an alkylthio group, an arylthio group, or a heterocyclic thio group.

DETAILED DESCRIPTION OF THE INVENTION

More specifically, $R_1$ represents an alkyl group such as methyl group, ethyl group, isopropyl group, t-butyl group, trifluoromethyl group, phenylmethyl group, methoxyethyl group, 2-phenoxyethyl group, 2-methylsulfonylethyl group, 2-hydroxyethyl group, 3,3,3-trifluoropropyl group, 2-fluoroethyl group, 2-chloroethyl group, 2-bromoethyl group, 2-cyanoethyl group, 3-oxobutyl group, or the like; an aryl group such as phenyl group, 4-methylphenyl group, 4-t-butylphenyl group, 4-acylaminophenyl group, a 4-halogenophenyl group, a 4-alkoxyphenyl group, or the like; or a heterocyclic group such as a 2-furyl group, 2-thienyl group, 2-pyrimidyl group, 2-benzothiazolyl group, 2-pyridyl group, 3-pyridyl group, 4-pyridiyl group, or the like.

$R_2$ represents a hydrogen atom, a halogen atom (e.g., chlorine atom, bromine atom, etc.), an alkyl group [including substituted alkyl groups such as a sulfonamido-substituted alkyl group (e.g., sulfonamidomethyl group, 1-sulfonamidoethyl group, 2-sulfonamidoethyl group, 1-methyl-2-sulfonamidoethyl group, 3-sulfonamidopropyl group, etc.), an acylamino-substituted alkyl group (e.g., acylaminomethyl group, 1-acylaminoethyl group, 2-acylaminoethyl group, 1-methyl-2-acylaminoethyl group, 3-acylaminopropyl, etc.), a sulfonamido-substituted phenylalkyl group e.g., p-sulfonamidophenylmethyl group, p-sulfonamidophenylethyl group, 1-(p-sulfonamidophenyl)ethyl group, p-sulfonamidophenylpropyl group, etc.), an acylamino-substituted phenylalkyl group (e.g., p-acylaminophenylmethyl group, p-acylaminophenylethyl group, 1-(p-acylaminophenyl-)ethyl group, p-acylaminophenylpropyl group, etc.), an alkylsulfonyl-substituted alkyl group (e.g., 2-dodecylsulfonylethyl group, 1-methyl-2-pentadecylsulfonylethyl group, octadecylsulfonylpropyl group, etc.), a phenylsulfonyl-substituted alkyl group e.g., 3-(2-butyl-5-octylphenylsulfonyl)propyl group, 2-(4-dodecyloxyphenylsulfonyl)ethyl group, etc.), and so on; and unsubstituted alkyl groups such as methyl group, ethyl group, hexyl group, dodecyl group, and so on], an aryl group [including substituted aryl groups such as sulfonamidophenyl group, acylaminophenyl group, an alkoxyphenyl group, an aryloxyphenyl group, a substituted-alkylphenyl group, sulfonamidonaphthyl group, acylaminonaphthyl group, etc., and unsubstituted aryl groups such as phenyl group, naphthyl group, and so on], a heterocyclic group (e.g , 2-furyl group, 2-thienyl group, 2-pyrimidyl group, 2-benzothiazolyl group, etc.), a cyano group, an alkoxy group (e.g., methoxy group, ethoxy group, 2-methoxyethoxy group, 2-dodecylethoxy group, 2-methanesulfonylethoxy group, etc.), an aryloxy group (e.g., phenoxy group, 2-methylphenoxy group, 4-t-butylphenoxy group, etc.), an acylamino group (e.g., acetamido group, benzamido group, tetradecanamido group, α-(2,4-di-t-amylphenoxy)butylamido group, γ-(3-t-butyl-4-hydroxyphenoxy)butylamido group, α-{4-(4-hydroxyphenylsulfonyl)phenoxy}decanamido group, etc.), an anilino group (e.g., phenylamino group, 2-chloroanilino group, 2-chloro-5-tetradecanamidoanilino group, 2-chloro-5-dodecyloxycarbonylanilino group, N-acetylanilino group, 2-chloro-5-{α-(3-t-butyl-4-hydroxyphenoxy)dodecanamido}anilino group, etc.), a ureido group (e.g., phenylureido group, methylureido group, N,N-dibutylureido group, etc.), a sulfamoylamino group (e.g., N,N-dipropylsulfamoylamino group, N-methyl-N-decylsulfamoylamino group, etc.), an alkylthio group (e.g., methylthio group, octylthio group, tetradecylthio group, 2-phenoxyethylthio group, 3-phenoxypropylthio group, 3-(4-t-butylphenoxy)propylthio group, etc.), an arylthio group (e.g., phenylthio group, 2-butoxy-5-t-octylphenylthio group, 3-pentadecylphenylthio group, 2-carboxyphenylthio group, 4-tetradecanamidophenylthio group, etc.), an alkoxycarbonylamino group (e.g., methoxycarbonylamino group, tetradecyloxycarbonylamino group, etc.), a sulfonamido group (e.g., methanesulfonamido group, hexadecanesulfonamido group, benzenesulfonamido group, p-toluenesulfonamido group, octadecanesulfonamido group, 2-methoxy-5-t-butylbenzenesulfonamido group, etc.), a carbamoyl group (e.g., N-ethylcarbamoyl group, N,N-dibutylcarbamoyl group, N-(2-dodecyloxyethyl)carbamoyl group, N-methyl-N-dodecylcarbamoyl group, N-{3-(2,4-di-t-amylphenoxy)propyl}carbamoyl group, etc.), a sulfamoyl group (e.g., N-ethylsulfamoyl group, N,N-dipropylsulfamoyl group, N-(2-dodecyloxyethyl)sulfamoyl group, N-ethyl-n-dodecylsulfamoyl group, N,N-diethylsulfamoyl group, etc.), a sulfonyl group (e.g., methanesulfonyl group, octanesulfonyl group, benzenesulfonyl group, toluenesulfonyl group, etc.), or an alkoxycarbonyl group (e.g., methoxycarbonyl group, butoxycarbonyl group, dodecylcarbonyl group, octadecylcarbonyl group, etc.). Of the groups set forth above, an alkyl group, an aryl group, an alkylthio group and an arylthio group, especially an alkyl group and an aryl group, are preferred over others.

$R'_2$ represents a substituted alkyl group such as a sulfonamido-substituted alkyl group (e.g., sulfonamidomethyl group, 1-sulfonamidoethyl group, 2-sulfonamidoethyl group, 1-methyl-2-sulfonamidoethyl group, 3-sulfonamidopropyl group, etc.), an acylamino-substituted alkyl group (e.g., acylaminomethyl group, 1-acylaminoethyl group, 2-acylaminoethyl group, 1-methyl-2-acylaminoethyl group, 3-acylaminopropyl group, etc.), a sulfonamido-substituted phenylalkyl group (e.g., p-sulfonamidophenylmethyl group, p-sulfonamidophenylethyl group, 1-(p-sulfonamidophenyl-)ethyl group, p-sulfonamidophenylpropyl group, etc.), an acylamino-substituted phenylalkyl group (e.g., p-acylaminophenylmethyl group, p-acylaminophenylethyl group, 1-(p-acylaminophenyl)ethyl group, p-acylaminophenylpropyl group, etc.), an alkylsulfonyl-substituted alkyl group (e.g., 2-dodecylsulfonylethyl group, 1-methyl-2-pentadecylsulfonylethyl group, octadecylsulfonylpropyl group, etc.), a phenylsulfonyl-substituted alkyl group (e.g., 3-(2-butyl-5-t-octylphenylsulfonyl)propyl group, 2-(4-dodecyloxyphenylsulfonyl)ethyl group, etc.), or so on; an unsubstituted alkyl group such as methyl group, ethyl group, hexyl group, dodecyl group, or so on; a substituted aryl group such as sulfonamidophenyl group, acylaminophenyl group, an alkoxyphenyl group, an aryloxyphenyl group, a substituted-alkylphenyl group, sulfonamidonaphthyl group, acylaminonaphthyl group, or so on; an unsubstituted aryl group such as phenyl group, naphthyl group, or so on; an alkylthio group such as methylthio group, octylthio group, tetradecylthio group, 2-phenoxyethylthio group, 3-phenoxypropylthio group, 3-(4-t-butylphenoxy)propylthio group, or so on; an arylthio group such as phenylthio group, 2-butoxy-5-t-octylphenylthio group, 3-pentadecylphenylthio group, 2-carboxyphenylthio group. 4-tetradecanamidophenylthio group, or so on; or a heterocyclic thio group such as 2-benzothiazoylthio group, 2,4-diphenoxy-1,3,5-triazole-6-thio group, 2-pyridylthio group, or so on. Of these groups, substituted alkyl groups and substituted aryl groups, especially substituted alkyl groups, are preferred over others.

X represents a hydrogen atom, a halogen atom (e.g., chlorine atom, bromine atom, iodine atom, etc.), a carboxyl group, a group linked through an oxygen atom (e.g., acetoxy group, propanoyloxy group, benzoyloxy group, 2,4-dichlorobenzoyloxy group, ethoxyoxaloyloxy group, pyruvoyloxy group, cinnamoyloxy group, phenoxy group, 4-cyanophenoxy group, 4-methanesulfonamidophenoxy group, 4-methanesulfonylphenoxy group, α-naphthoxy group, 3-pentadecylphenoxy group, benzyloxycarbonyloxy group, ethoxy group, 2-cyanoethoxy group, benzyloxy group, 2-phenethyloxy group, 2-phenoxyethoxy group, 5-phenyltetrazoyloxy group, 2-benzothiazolyloxy group, etc.), a group linked through a nitrogen atom (e.g., benzenesulfonamido group, N-ethyltoluenesulfonamido group, heptafluorobutanamido group, 2,3,4,5,6-pentafluorobenzamido group, octanesulfonamido group, p-cyanophenylureido group, N,N-diethylsulfamoylamino group, 1-piperidyl group, 5,5-dimethyl-2,4-dioxo-3-oxazolidinyl group, 1-benzylethoxy-3-hydantoinyl group, 2N-1,1-dioxo-3(2H)-oxo-1,2-benzoisothiazolyl group, 2-oxo-1,2-dihydro-1-pyridinyl group, imidazolyl group, pyrazolyl group, 3,5-diethyl-1,2,4-triazole-1-yl group, 5- or 6-bromobenzotriazole-1-yl group, 5-methyl-1,2,3,4-tetrazole-1-yl group, benzimidazolyl group, etc.), or a group linked through a sulfur atom (e.g., phenylthio group, 2-carboxyphenylthio group, 2-methoxy-5-t-octylphenylthio group, 4-methanesulfonylphenylthio group, 4-octanesulfonamidophenylthio group, benzylthio group, 2-cyanoethylthio group, 1-ethoxycarbonyltridecylthio group, 5-phenyl-2,3,4,5-tetrazolylthio group, 2-benzothiazolyl group, etc.).

When $R_1$, $R_2$, $R'_2$, or X is a divalent group and therethrough, the coupler (I) or (II) forms a bis compound, then, $R_1$, $R_2$, or $R'_2$ represents a substituted or unsubstituted alkylene group (e.g., methylene group, ethylene group, 1,10-decylene group, $—CH_2CH_2—O—CH_2CH_2—$, etc.), or a substituted or unsubstituted phenylene group (e.g., 1,4-phenylene group, 1,3-phenylene group,

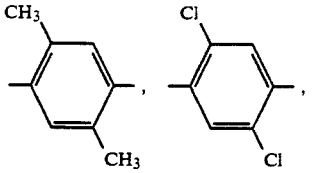

etc.) and X represents a divalent group obtained by converting any of the above-cited monovalent groups into the corresponding divalent group at a proper position.

When the coupler represented by the foregoing formula (I) or (II) constitutes a part of a vinyl monomer, a linkage group represented by $R_1$, $R_2$, or $R'_2$ includes groups formed by connecting some groups selected from substituted or unsubstituted alkylene groups (e.g., methylene group, ethylene group, 1,10-decylene group, $—CH_2CH_2OCH_2CH_2—$, etc.), substituted or unsubstituted phenylene groups (e.g., 1,4-phenylene group, 1,3-phenylene group,

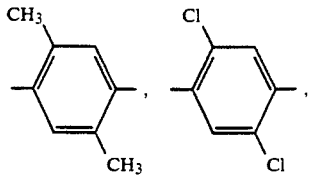

etc.), —NHCO—, CONH—, —O—, —OCO—, and aralkylene groups (e.g.,

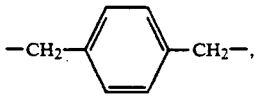

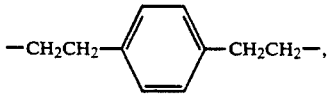

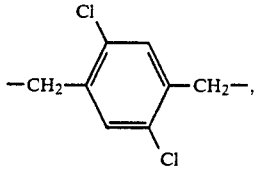

etc.)

Suitable examples of linkage groups include

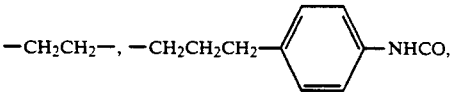

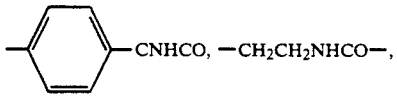

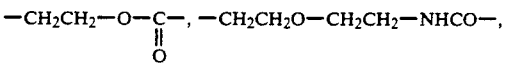

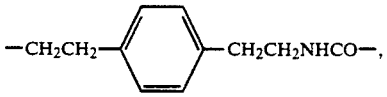

and the like.

In addition to the group derived from the coupler of the foregoing formula (I) or (II), the vinyl group may further have a substituent group. Suitable substituent groups include a hydrogen atom, a chlorine atom, and a lower alkyl group containing 1 to 4 carbon atoms (e.g., methyl group, ethyl group, etc.).

A monomer having a moiety represented by the foregoing general formula (I) or (II) may form a copolymer together with a non-color-forming ethylenic monomer which is not coupled with an oxidation product of an aromatic primary amine developing agent.

As suitable examples of non-color-forming ethylenic monomers which are not coupled with an oxidation product of an aromatic primary amine developing agent, mention may be made of acrylic acid, α-chloroacrylic acid, α-alkylacrylic acids (e.g., methacrylic acid, etc.), esters and amides derived from acrylic acids as described above (e.g., acrylamide, n-butylacrylamide, t-butylacrylamide, diacetoneacrylamide, methacrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate, and β-hydroxy methacrylate), methylenebisacrylamide, vinyl esters (e.g., vinyl acetate, vinyl propionate, and vinyl laurate), acrylonitrile, methacrylonitrile, aromatic vinyl compounds (e.g., styrene and its derivatives, vinyltoluene, divinylbenzene, vinylacetophenone, and sulfostyrene), itaconic acid, citraconic acid, crotonic acid, vinylidene chloride, vinyl alkyl ethers (e.g., vinyl ethyl ether), maleic acid, maleic anhydride, maleic acid esters, N-vinyl-2 pyrrolidone, N-vinylpyridine, 2- and 4-vinylpyridines, and so on. These non-color-forming ethylenic unsaturated monomers can be used in combination with two or more thereof. For example, a combination of n-butyl acrylate with methyl acrylate, that of styrene with methacrylic acid, that of methacrylic acid with acrylamide, that of methyl acrylate with diacetoneacrylamide, and the like can be employed.

As well known in the field of polymer color couplers, non-color-forming ethylenic unsaturated monomers to be copolymerized with water-insoluble solid monomer couplers can be so selected as to exert a favorable influence upon physical properties and/or chemical properties of the resulting copolymers, such as solubility, compatibility with binders of photographic colloidal compositions, e.g., gelatin, flexibility, thermal stability, and so on.

The polymer couplers which can be used in the present invention may be either water-soluble or water-insoluble. However, particularly preferred are polymer coupler latexes.

Specific examples of typical magenta couplers which can be used in the present invention are illustrated below. However, the invention is not intended to be construed as being limited to these specific examples. Unless otherwise indicated, all fractions of constituent monomers in the polymer couplers instanced below are by weight.

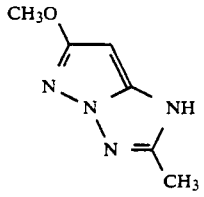
(1)

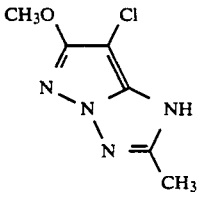
(2)

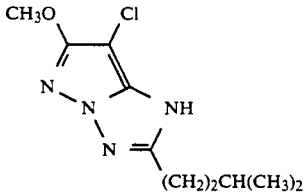
(3)

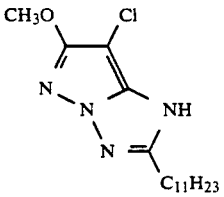
(4)

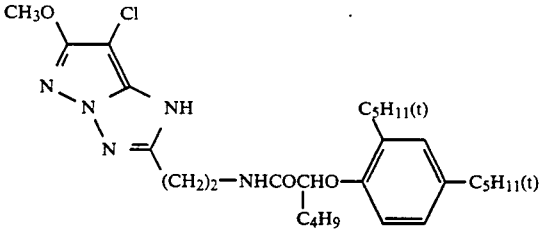
(5)

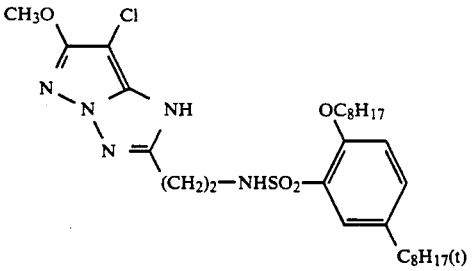
(6)

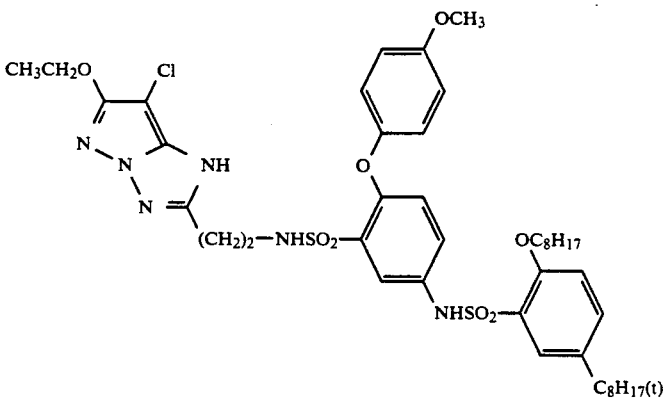
(7)

-continued
(8)
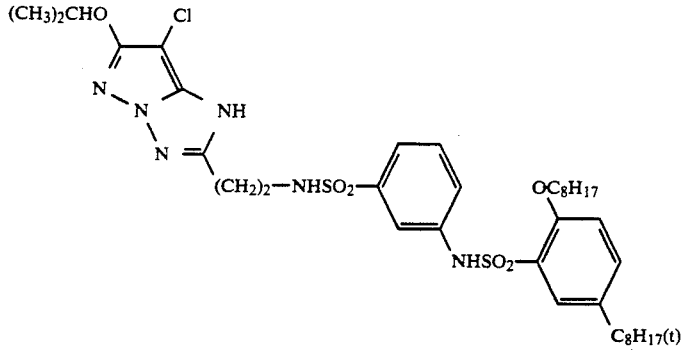
(9)
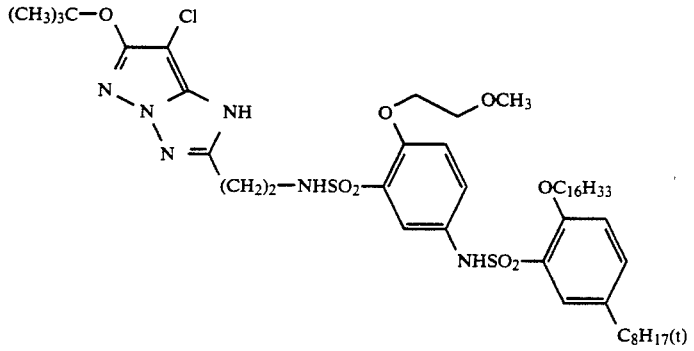
(10)
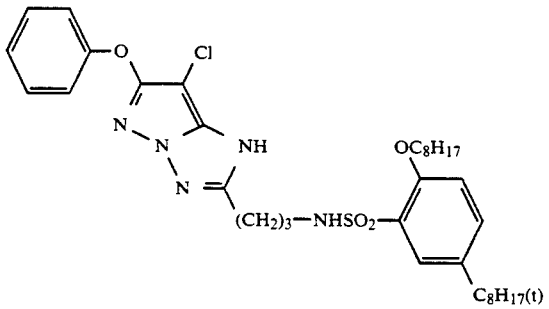
(11)
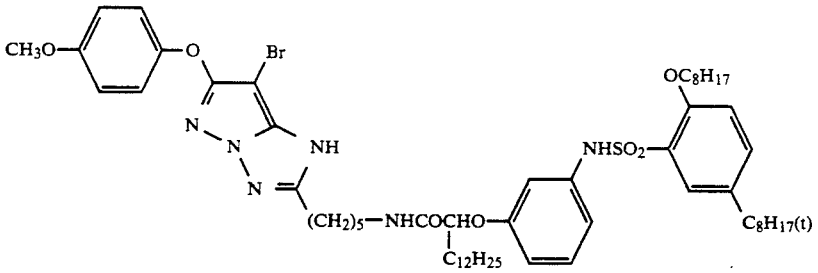
(12)
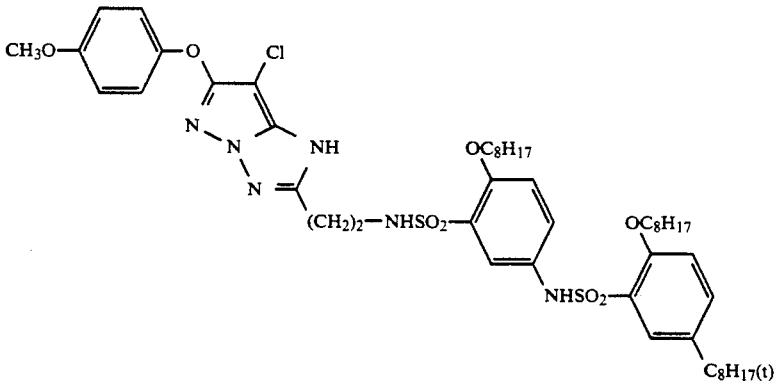

-continued
(13)
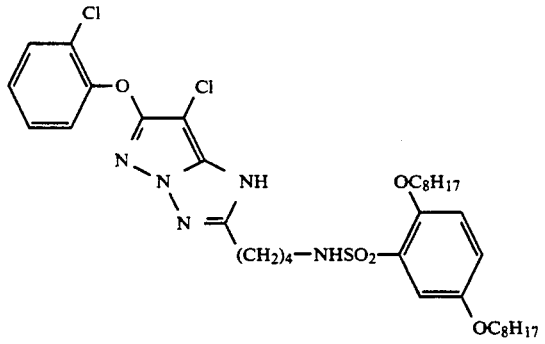
(14)
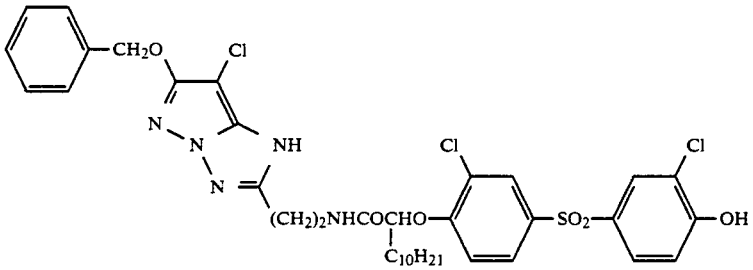
(15)
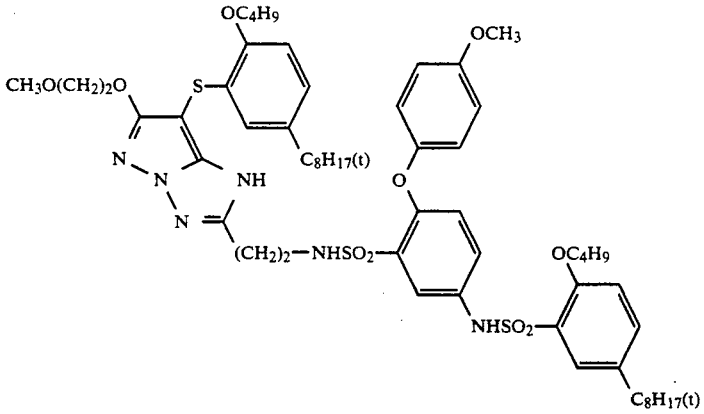
(16)
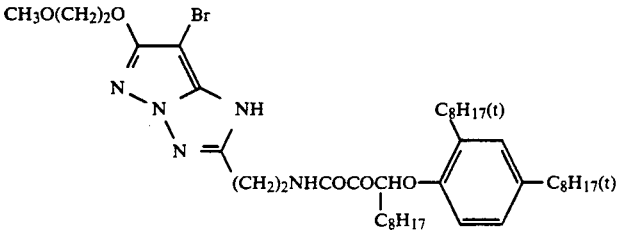

-continued
(17)
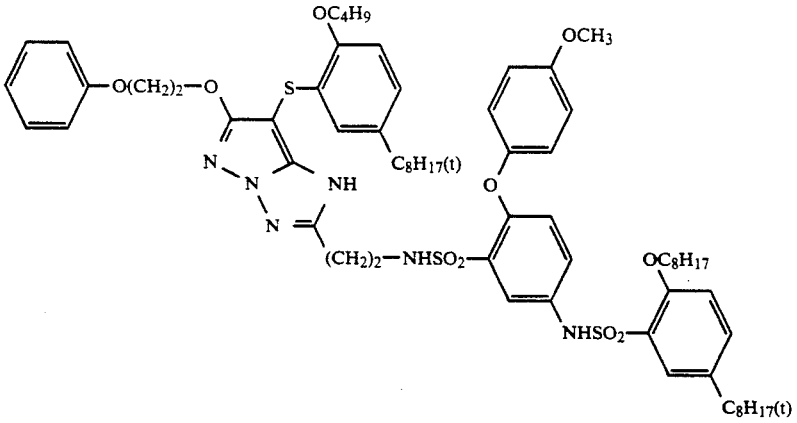
(18)
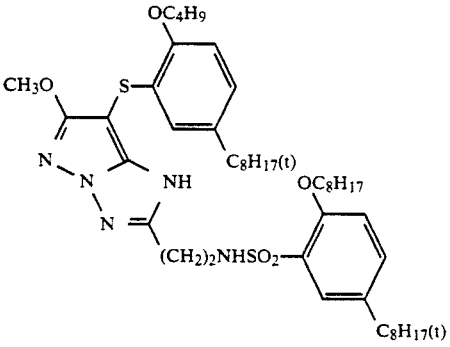
(19)
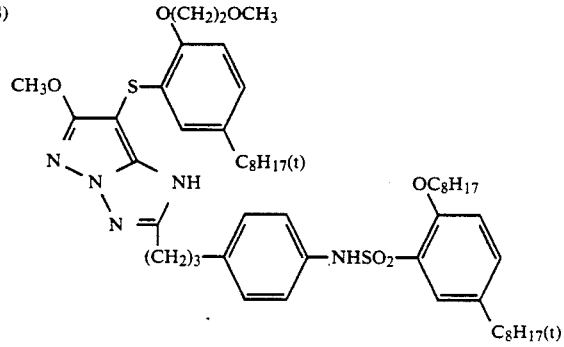
(20)
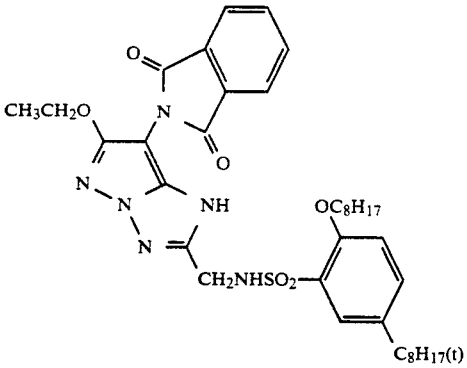
(21)
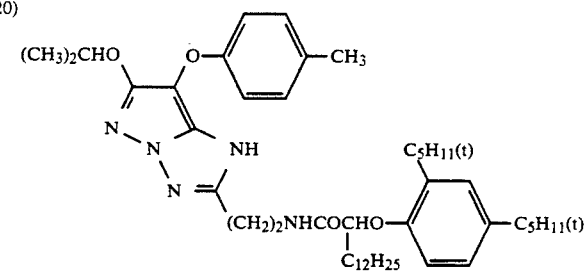
(22)
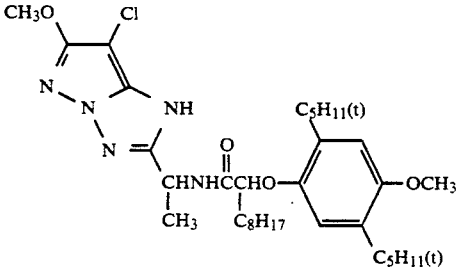

-continued
(23)
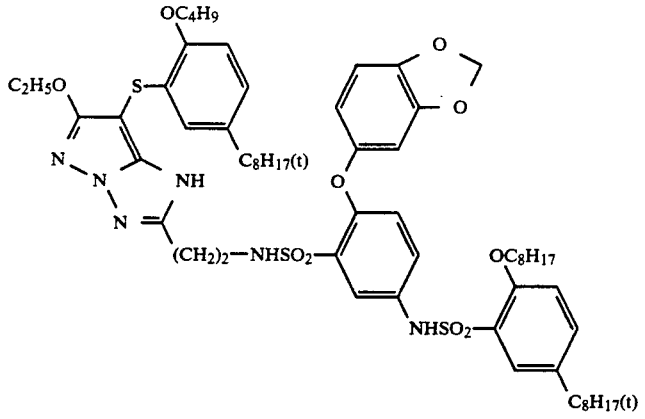
(24)
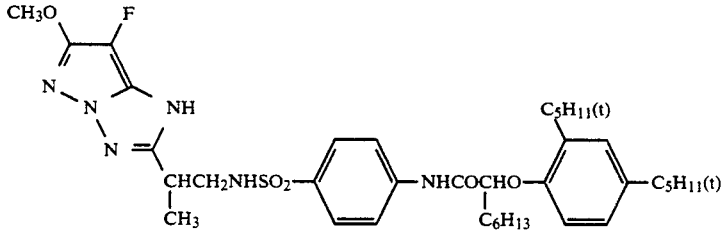
(25)
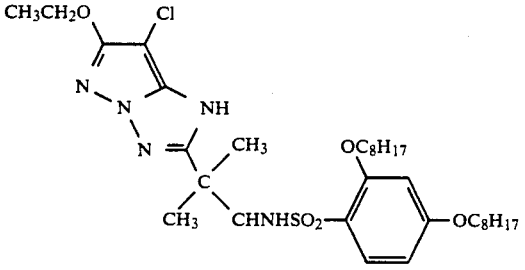
(26)
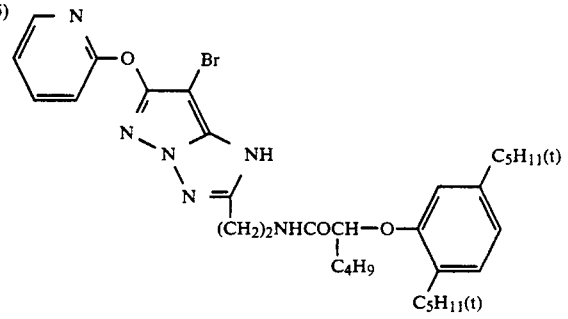
(27)
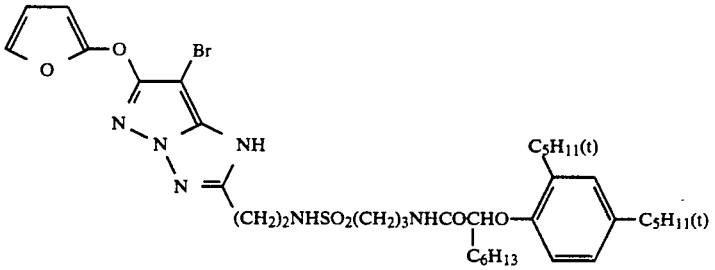
(28)
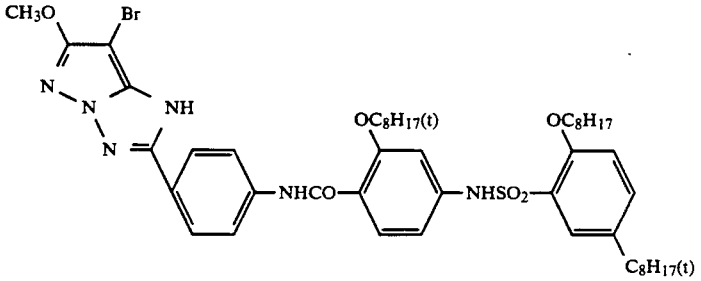

-continued
(29)
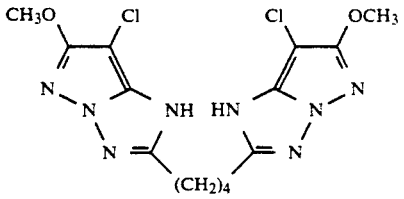
(30)
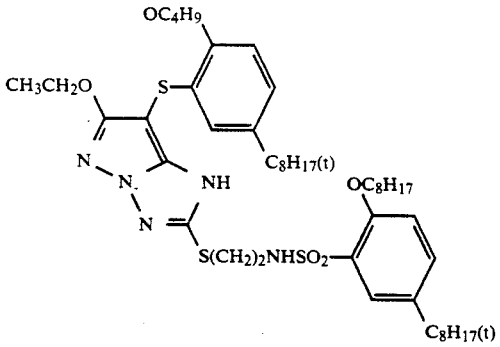
(31)
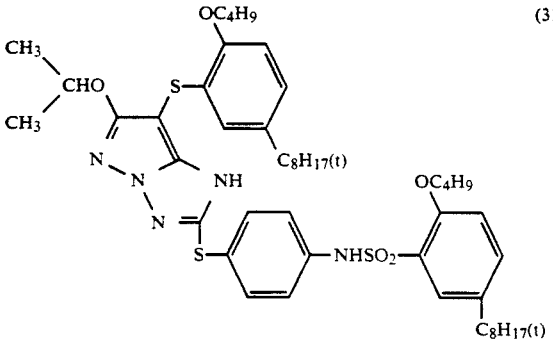
(32)
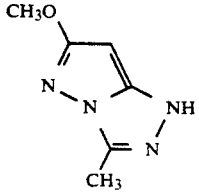
(33)
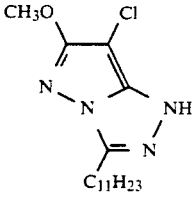
(34)
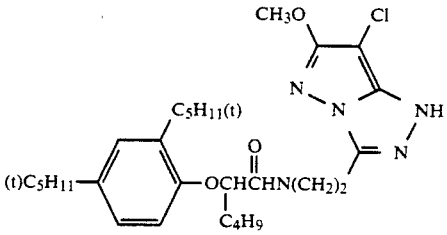
(35)
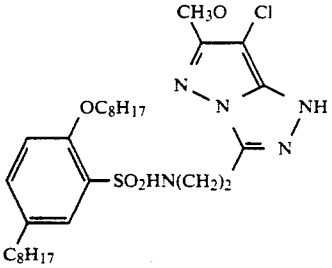
(36)
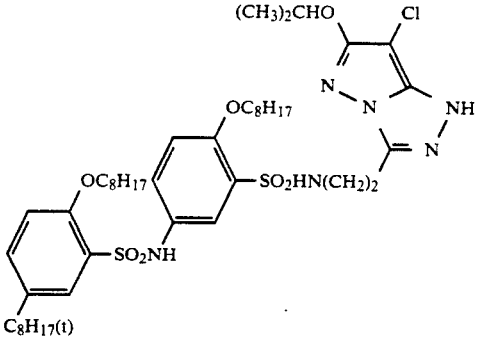
(37)
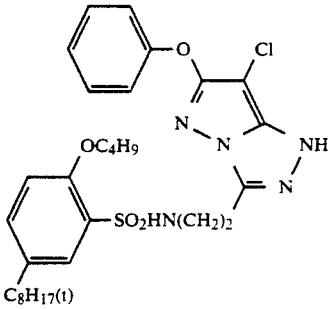
(38)
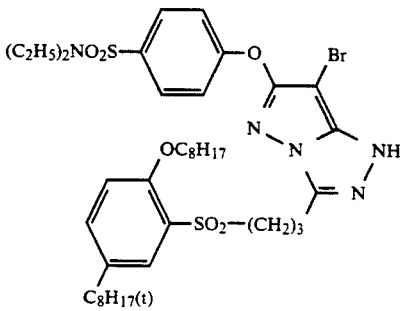

-continued
(39)
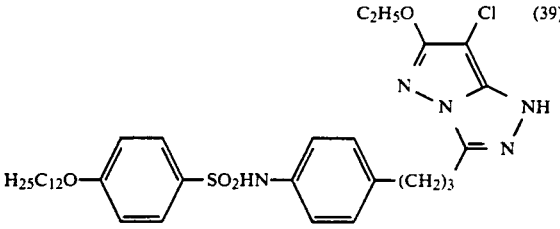
(40)
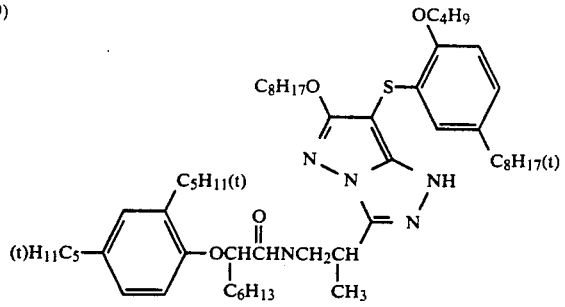
(41)
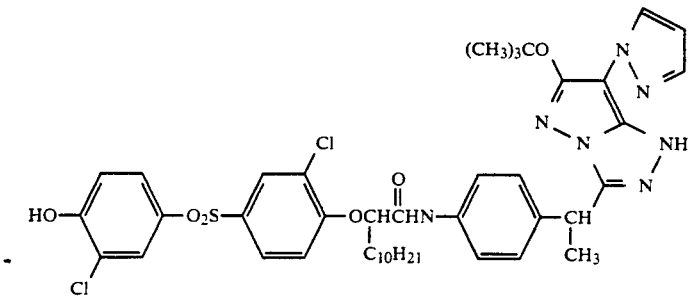
(42)
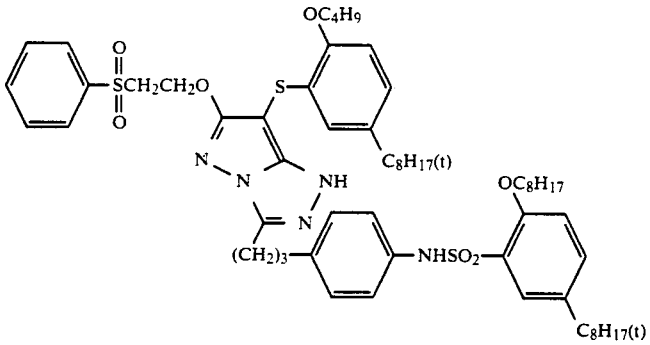
(43)
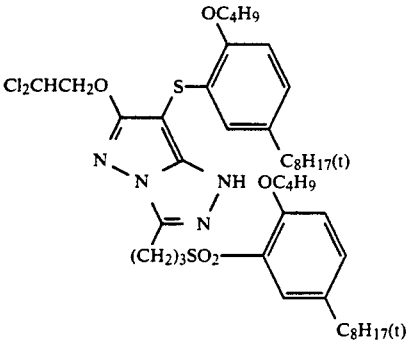
(44)
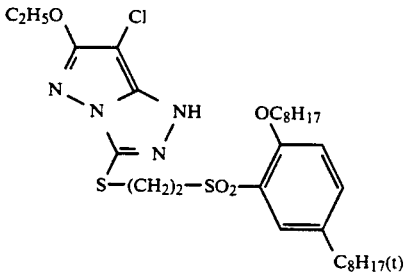

-continued
(45)
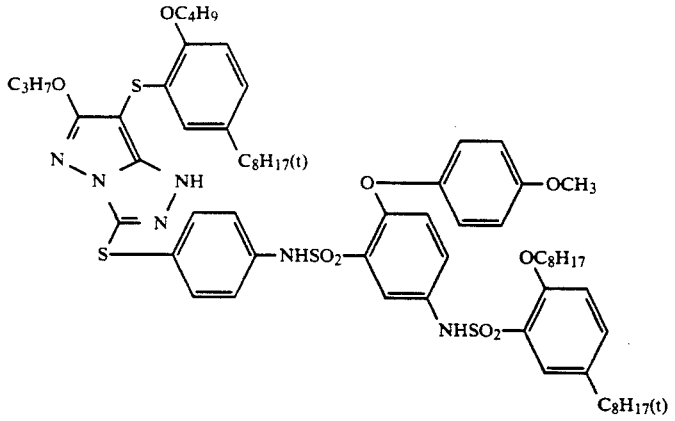
(46)
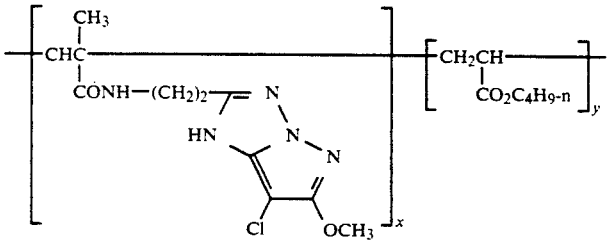
x:y = 50:50
(47)
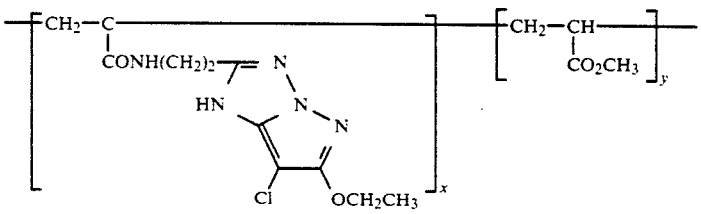
x:y = 45:55
(48)
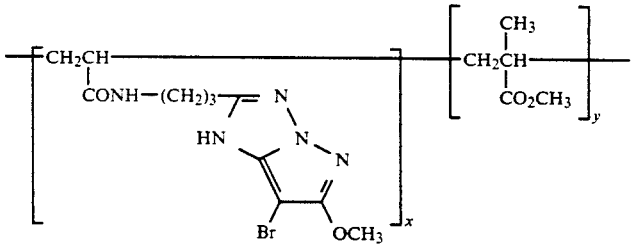
x:y = 45:55
(49)
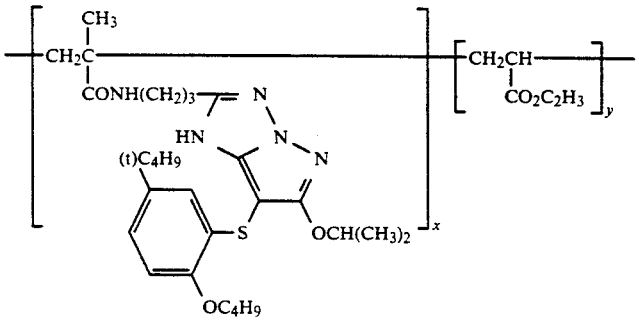
x:y = 50:50

-continued
(50)
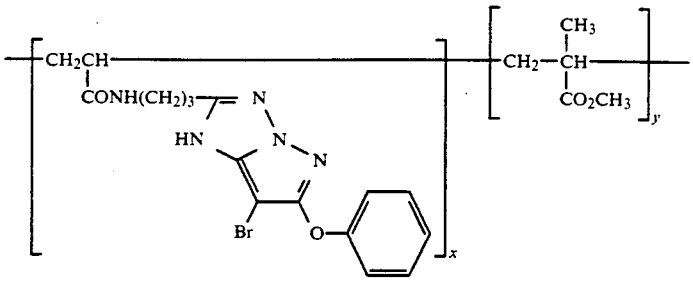
x:y = 45:55
(51)
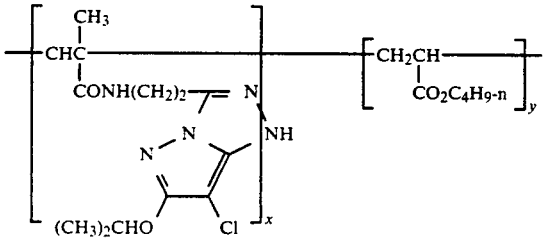
x:y = 50:50
(52)
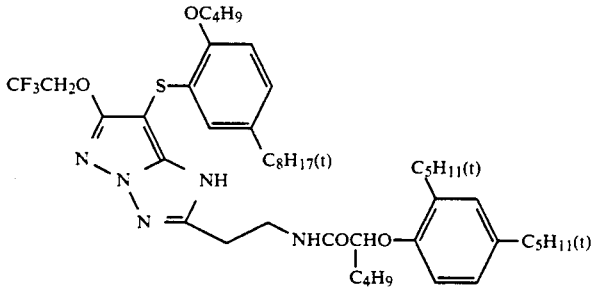
(53)
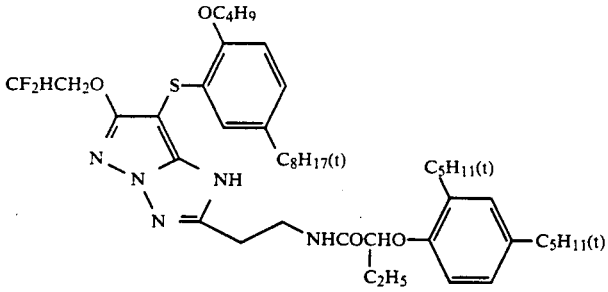
(54)
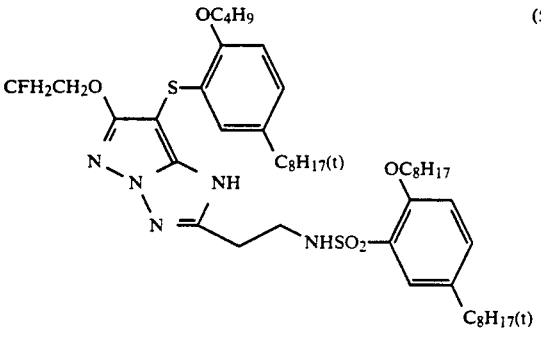
(55)
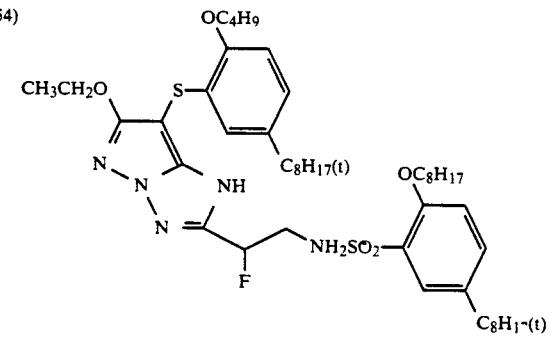

-continued (56)

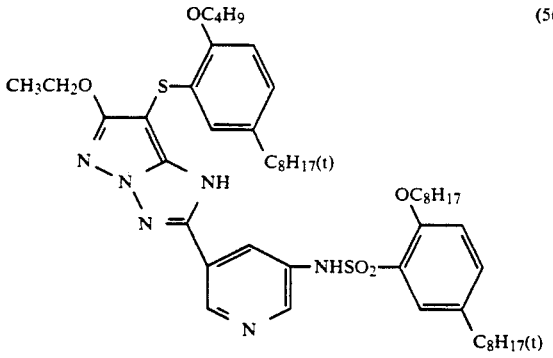

(57)

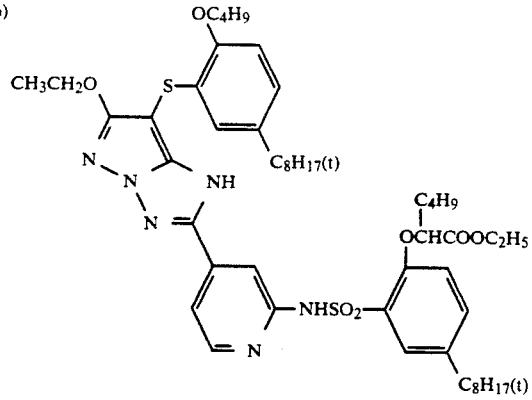

(58)

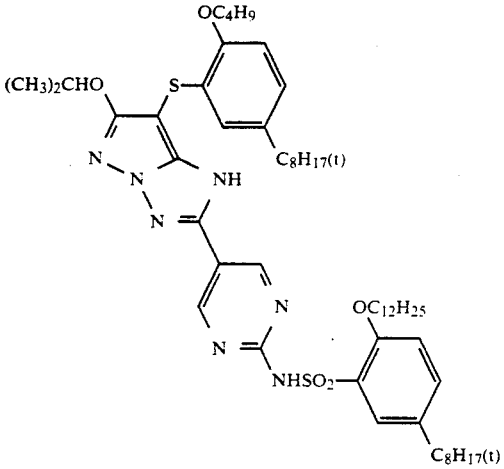

(59)

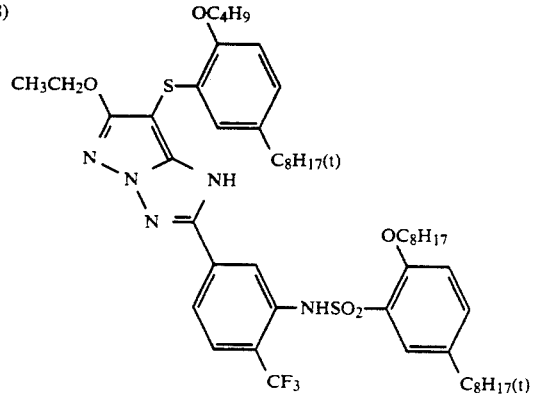

(60)

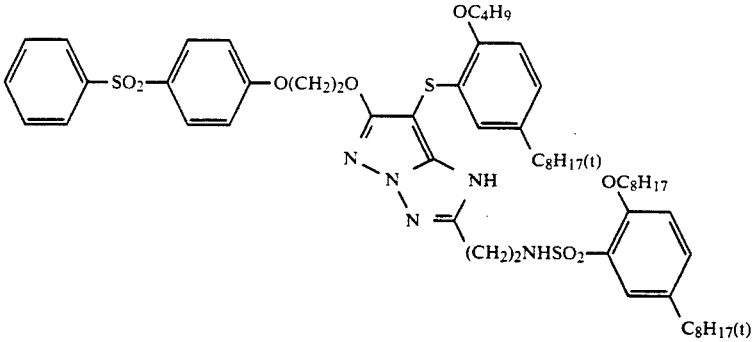

A general process for synthesizing the couplers of the present invention is described below. Some of the inventors have disclosed in JP-A-60-197688 a process for synthesizing 1H-pyrazolo-[1,5-b]-1,2,4-triazoles which have a hydrogen atom or an alkyl group at the 6-position. The couplers of the present invention (formula (I)) can be synthesized in basically the same manner as those described above except that different starting materials are used. The synthesis scheme is illustrated below.

Synthesis Scheme

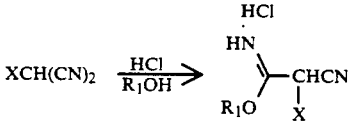

-continued

Synthesis Scheme

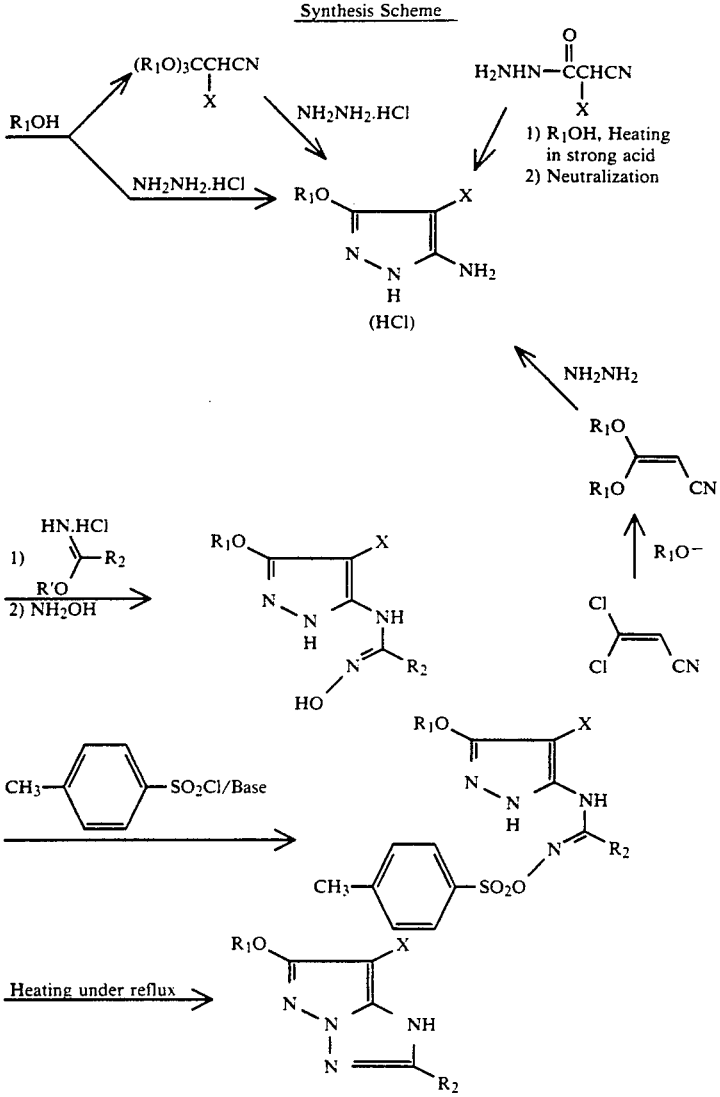

In the above scheme, $R_1$, $R_2$ and X have the same meanings as in the foregoing formula (I), respectively; and R′ represents an alkyl group or an aryl group.

The substituent X may be introduced from the start as shown above, or the synthesis may be conducted using the compound wherein X is a hydrogen atom as a starting material and various substituents for X may be introduced after synthesis of the skeleton as described hereinafter.

The 1H-pyrazolo[5,1-c]-1,2,4-triazole couplers (formula (II)) can be synthesized using 3-alkoxy (or aryloxy)-5-hydrazinopyrazoles as a starting material according to the method described in JP-B-48-30895 (the term "JP-B" as used herein means an "examined Japanese patent publication").

The polymer couplers can be synthesized using a solution polymerization processes of an emulsion polymerization process. The solution polymerization can be carried out using the processes described in U.S. Pat. No. 3,451,820 and JP-A-58-28745. Specifically, a monomer coupler having the moiety represented by the formula (I) and a non-color-forming ethylenic monomer (e.g., acrylic acid, o-chloroacrylic acid, alacrylic acid such as methacrylic acid, or an ester or amide derived from such an acrylic acid (e.g., acrylamide, n-butyl acrylamide, n-butyl methacrylate, methyl methacrylate, ethyl methacrylate, etc.)) are dissolved in or mixed with a soluble organic solvent (e.g., dioxane, methyl cellosolve, etc.) in an appropriate ratio, and polymerization can be initiated at a proper temperature (about 30° to 100° C.) through formation of free radicals by applying thereto a physical means such as UV irradiation, high energy irradiation, or the like, or by applying chemical means such as use of initiators (e.g., persulfates, hydrogen peroxide, benzoyl peroxide, azobisalkylnitriles, etc.). After completion of the polymerization reaction, the polymer can be isolated by extracting the product into an organic organic solvent concentrating the product, or pouring the product into water. On the other hand, the emulsion polymerization can be effected using the method described in U.S. Pat. No. 3,370,952.

A general process for introducing a coupling split-off group is described below.

(1) Process for Linking an Oxygen Atom

Linking an oxygen atom can be effected using a process as described, e.g., in U.S. Pat. No. 3,9265,631 and JP-A-57-70817. Specifically, a 4-equivalent coupler having the matrix nucleus of the present invention is converted to a dye in a manner as in Example 1 described below, and the resulting dye is hydrolyzed in the presence of an acid catalyst to convert it into a ketone derivative. The ketone derivative is subjected to hydrogenation using a Pd-on-carbon catalyst, reduction with a Zn-acetic acid mixture, or reduction with sodium borohydride, to thereby synthesize a 7-hydroxyl derivative. The thus obtained product is allowed to react with a halide to yield an intended coupler to which an oxygen atom is linked.

(2) Process for Linking a Nitrogen Atom

Linking a nitrogen atom is divided roughly into three groups. Processes falling into the first group involve, as described in U.S. Pat. No. 3,419,391, nitrosifying the coupling active site of a coupler with an appropriate nitrosifying agent, reducing the nitroso group by a suitable process (for example, a hydrogenation process using a catalyst like Pd-on-carbon or a chemical reduction process using stannous chloride or so on), and then allowing the resulting 7-amino compound to react with a halide to yield predominantly the amide compound.

Processes falling into the second group involve, as described in U.S. Pat. No. 3,725,067, halogenating the 7-position of a coupler with an appropriate halogenating agent such as sulfuryl chloride, chlorine gas, bromine, N-chlorosuccinimide, N-bromosuccinimide, or the like, and the replacing the halogen with a nitrogen-containing hetero ring in the presence of an appropriate base catalyst such as triethylamine, sodium hydroxide, diazabicyclo[2,2,2]octane, anhydrous potassium carbonate, etc. according to the process described in JP-B 56-45135, thus the coupler which is linked to a nitrogen atom at the 7-position being synthesized. Of couplers to which an oxygen atom is linked, those linking to a phenoxy group at the 7-position can also be synthesized by the processes falling into this group.

Processes falling into the third group are effective in introducing a $6\pi$- or $10\pi$-electron system aromatic nitrogen-containing hetero ring to a coupler at the 7-position and involve, as described in JP-B-57-36577, adding 2 moles or more of a $6\pi$- or $10\pi$-electron system aromatic nitrogen-containing hetero ring to 1 mole of a 7-halogenated coupler synthesized in the course of the second group process described above and heating the mixture at a temperature of from 50° C. to 150° C. without using any solvent, or heating it at a temperature of from 30° C. to 150° C. in an aprotic polar solvent such as dimethylfomamide, sulfolane, hexamethylphosphotriamide, or so on to introduce the aromatic nitrogen-containing heterocyclic group to the 7-position of the coupler via the nitrogen atom.

(3) Process for Linking a Sulfur Atom

Couplers substituted by an aromatic mercapto or heterocyclic mercapto group at the 7-position can be synthesized using the process described in U.S. Pat. No. 3,227,554, which involves dissolving an arylmercaptane, a heterocyclic mercaptane, or a disulfide corresponding thereto in a halogenated hydrocarbon solvent, converting the mercaptane or disulfide into a sulfenyl chloride with chlorine or sulfuryl chloride, and then adding the sulfenyl chloride to a 4-equivalent coupler dissolved in an aprotic solvent. As for the processes of introducing an alkylmercapto group to the 7-position of a coupler, the process described in U.S. Pat. No. 4,264,723 which comprises introducing an mercapto group to the coupling active site of a coupler and allowing a halide to act on the mercapto group, and a one-step processing using S-(alkylthio)isothioureas or hydrochlorides (or hydrobromides) are employed effectively.

SYNTHESIS EXAMPLE 1

Synthesis of Illustrative Coupler (6)

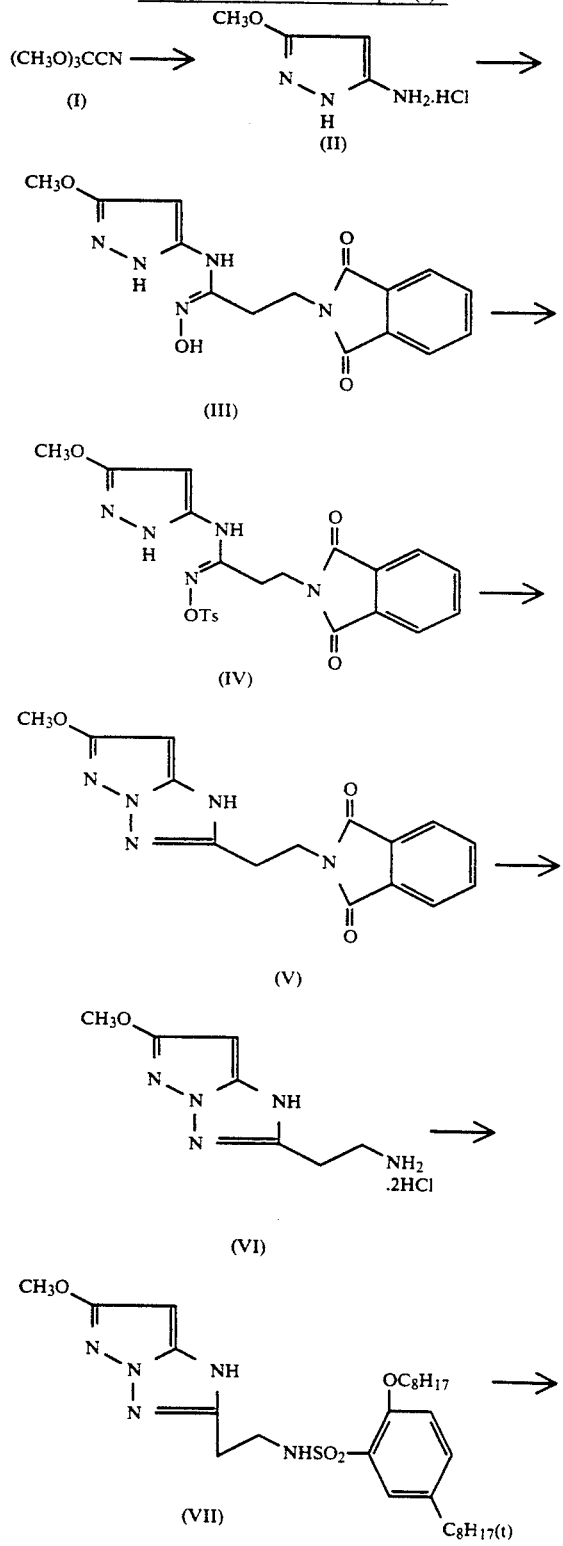

-continued

Synthesis of Illustrative Coupler (6)

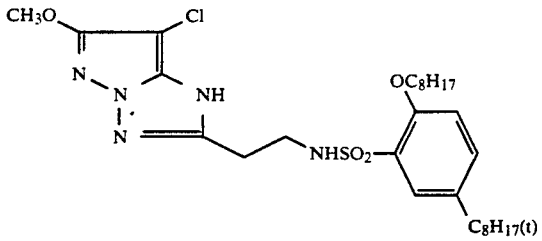

(Illustrative Coupler (6))

42 g (0.29 mole) of trimethyl orthocyanoacetate (I) (prepared by the method described in S. M. MacElvain et al, *Journal of American Chemical Society*, volume 71, page 40 (1949)) and 21.8 g (0.32 mole) of hydrazine hydrochloride were heated in 100 ml of methanol under reflux for 20 hours, and then the solvent was removed by means of an evaporator. The product was recrystallized from methanol. Thus, 36.2 g (yield: 84%) of 3-amino-5-methoxypyrazole hydrochloride (II) was obtained.

Melting Point: 145°-150° C.

NMR Spectrum (in a form of free base dissolved in $CDCl_3$):

δ 3.80 (3H, s , 4.90 (1H, s), 5.30-6.90 (2-3H, br)

A 45.0 g (0.3 mole) portion of (II) was dissolved in methanol, and the solution was neutralized with 66 ml (0.33 mole) of a 28% methanol solution of sodium methoxide (named SM-28). 80.6 g (0.3 mole) of 3-phthalimidopropionimide methyl ester hydrochloride was added thereto, and the mixture was stirred for 1 hour at room temperature. Further, a hydroxylamine aqueous solution (prepared from 20.9 g (0.3 mole) of hydroxylamine hydrochloride and 60.3 ml (0.3 mole) of SM-28) was added thereto, and the resulting mixture was stirred for 3 hours at room temperature. Crystals thus precipitated were filtered off, washed with water and acetonitrile, and dried to obtain 71.1 g (yield: 72%) of (III).

Melting Point: 196°-199° C. (decomposed)

NMR Spectrum (DMSO-$d_6$): δ 2.5-2.8 (2H), 3.70 (3H, s), 3.6-3.9 (2H), 5.39 (2H, brs), 7.82 (4H, s)

A 72 g (0.22 mole) portion of (III) was added to 150 ml of acetonitrile, a solution containing 41.7 g (0.22 mole) of p-toluenesulfonyl chloride dissolved in 50 ml of acetonitrile was added dropwise thereto at room temperature over a period of about 1 hour while stirring. After completion of the dropwise addition, stirring was continued for an additional about 30 minutes. Then, 20 ml (0.24 mole) of pyridine was added thereto, followed by stirring for about 30 minutes. The reaction mixture was poured into ice water, and crystals precipitated were filtered off and washed with acetonitrile. Thus, 80.0 g of (IV) was obtained in a 75.6% yield. A 15.8 g (0.33 mole) portion of (IV) was heated in a mixture of 300 ml methanol and 2.9 ml (0.036 mole) of pyridine under reflux for about 2 hours, thus precipitating crystals. The crystals were filtered off, washed with methanol, and dried to obtain 7.9 g (yield: 68.8%) of (V).

Melting Point: 225°-228° C.

NMR Spectrum :(DMSO-$d_6$): δ 3.03 (2H, t, J=7.9), 3.70 (3H, s), 3.87 (2H, t, J=7.0), 5.10 (1H, s), 7.80 (4H, s), 12.40 (1H, brs)

To a solution containing 40.8 g (0.13 mole) of (V) dissolved in 200 ml of methanol was added 7.9 g (0.16 mole) of hydrazine monohydrate. The mixture was heated under reflux for about 3 hours. Crystals thus precipitated were collected by filtration and dissolved again in methanol. 27.5 ml of concentrated hydrochloric acid was added thereto, and the mixture was stirred. The crystals remaining undissolved (phthalhydrazide) were removed by filtration. The filtrate was evaporated to dryness to yield crude crystals of (VI). The crude crystals were mixed with acetonitrile, filtered off, and washed to give 29.8 g of (VI) in an 89.6% yield.

Melting Point: 165°-170° C. (decomposed)

NMR Spectrum (DMSO-$d_6$): δ 3.0-3.3 (4H), 3.75 (3H, s , 8.35 (~5H, br)

To a 5.0 g (0.20 mole) portion of (VI) was added 50 ml of dimethylacetamide and further added 9.6 ml (0.069 mole) of triethylamine at room temperature. The mixture was stirred and cooled with ice water. A solution of 8.2 g (0.020 mole) of 2-octyloxy-5-t-octylbenzenesulfonyl chloride in acetonitrile was added dropwise thereto. The reaction product was extracted with ethyl acetate and recrystallized from a mixed solvent of n-hexane and ethyl acetate to give 8.0 g of (VII) in a 72.4% yield. Melting Point 170°-172° C.

An 8.0 g (0.014 mole) portion of (VII) was dissolved in 120 ml of ethyl acetate, and the solution was added with 1.74 g (0.013 mole) of N-chlorosuccinimide in two or three portions at room temperature. The reaction product was extracted with ethyl acetate, and the extract was dried, concentrated, and recrystallized from a 2:1 mixed solvent of n-hexane and ethyl acetate to give 5.5 g of illustrative Coupler (6) in a 64.7% yield.

Melting Point: 155°-156° C.

Mass Analysis (FD): 596 ($M^+$)

Elemental Analysis: Calcd.: C, 58.44%; H, 7.72%; N, 11.75%; Found: C, 58.31%, H, 7.72%; N, 11.57%

SYNTHESIS EXAMPLE 2

Synthesis of Illustrative Coupler (15):

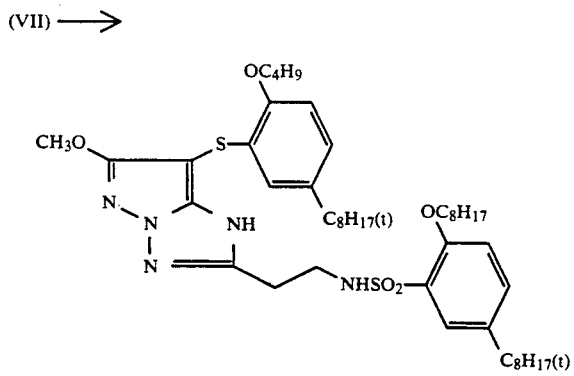

5.6 g (0.0095 mole) of 2-butoxy-5-t-octyl disulfide was dissolved in 20 ml of dichloromethane. 1.3 g (0.0095 mole) of sulfuryl chloride was added to the solution at room temperature, and the mixture was stirred for 30 minutes, followed by removal of the solvent using an evaporator. Thus, 2-butoxy-5-octylsulfenyl chloride was obtained. It was dissolved in 10 ml of dichloromethane, and a solution containing 10.6 g (0.0189 mole) of (VII) dissolved in 40 ml of DMF (dimethylformamide) was added to the solution at room temperature. After stirring at a temperature of 42° C. to 44° C. for 1 hour, the mixture was extracted with ethyl acetate. The extract was dried, concentrated, and purified by silica gel column chromatography to give 5.6 g (yield: 70%) of illustrative Coupler (15) in a powder form.

Mass Analysis (FD): 854 ($M^+$)

Elemental Analysis: Calcd.: C, 66.12%; H, 8.79%; N, 8.21%; Found: C, 65.91%, H, 8.95%; N, 8.08%

Magenta dye images produced from the magenta couplers to be employed in the present invention are enhanced in fastness to light and improved in resistance to yellow stain formation due to heat, by a combined use with color image stabilizers represented by the following formula:

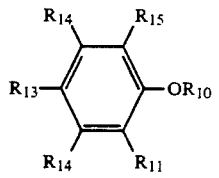

wherein $R_{10}$ represents a hydrogen atom, an alkyl group, an aryl group, or a heterocyclic group; $R_{11}$, $R_{12}$, $R_{14}$, and $R_{15}$ each represents a hydrogen atom, a hydroxyl group, an alkyl group, an aryl group, an alkoxy group, an acylamino group, an alkoxycarbonyl group, or a sulfonamido group; and $R_{13}$ represents an alkyl group, a hydroxyl group, an aryl group, or an alkoxy group, provided that $R_{10}$ and $R_{11}$ may combine with each other to form a 5- or 6-membered ring or a methylenedioxy ring, and that $R_{13}$ and $R_{14}$ may combine with each other to form a 5-membered hydrocarbon ring.

These compounds include those described in U.S. Pat. Nos. 3,935,016, 3,982,944 and 4,254,216; JP-A-55-21004; JP-A-54-145530; British Patents 2,077,455A and 2,062,888A; U.S. Pat. Nos. 3,764,337, 3,432,300, 3,574,627 and 3,573,050; JP-A-52-152225; JP-A-53-20327; JP-A-53-17729; JP-A-55-6321; British Patent 1,347,556; British Patent 2,066,975A; JP-B-54-12337; JP-B-48-31625; U.S. Pat. No. 3,700,455; and JP-A-61-90155.

In accordance with a preferred embodiment of the present invention, the couplers of the present invention are incorporated in a silver halide color photographic material.

The couplers of the present invention may be incorporated in a light-sensitive material or may be added to a color developing bath. A suitable content of the coupler in the light-sensitive material ranges from $2\times10^{-3}$ mole to $5\times10^{-1}$ mole, preferably from $1\times10^{-2}$ mole to $5\times10^{-1}$ mole, per mole of silver halide. When the coupler is a polymeric coupler, its amount is so adjusted that the amount of the color-forming moiety falls into the above-described range. A suitable amount of the coupler to be added to a color developing agent ranges from 0.001 mole to 0.1 mole, preferably from 0.01 mole to 0.05 mole, per liter of the bath containing the same.

The pyrazoloazole couplers of the present invention can be introduced into a light-sensitive material using various known methods of dispersing. For instance, the dispersion can be effected by a solid dispersion method, an alkaline dispersion method, preferably a latex dispersion method, and more preferably an oil-in-water dispersion method. In the oil-in-water dispersion method, couplers are dissolved in either a high boiling organic solvent having a boiling point of 175° C. or above or a so-called auxiliary solvent having a low boiling point, or in a mixture of these solvents and then dispersed finely into an aqueous medium like water or an aqueous gelatin solution in the presence of a surface active agent. Suitable examples of high boiling organic solvents are described in, for example, U.S. Pat. No. 2,322,027, and so on. The dispersion may be accompanied by phase inversion. Further, the auxiliary solvent used may be removed from the dispersion or decreased in content therein through distillation, noodle washing, ultrafiltration, or so on, if desired, in preference to coating of the dispersion.

Specific examples of high boiling organic solvents which can be used include phthalic acid esters (e.g., dibutyl phthalate, dicyclohexyl phthalate, di-2-ethylhexyl phthalate, decyl phthalate, etc.), phosphoric or phosphonic acid esters (e.g., triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphate, etc.), benzoic acid esters (e.g., 2-ethylhexyl benzoate, dodecyl benzoate, 2-ethylhexyl-p-hydroxybenzoate, etc.), amides (e.g., diethyldodecanamide, N-tetradecylpyrrolidone, etc.), alcohols and phenols (e.g., isostearyl alcohol, 2,4-di-tert-amylphenol, etc.), aliphatic carboxylic acid esters (e.g., dioctyl azelate, glycerol tributyrate, isostearyl lactate, trioctylcitrate, etc.), aniline derivatives (e.g., N,N-dibutyl-2-butoxy-5-tert-octylaniline, etc.), hydrocarbons (e.g., paraffins, dodecylbenzene, diisopropylnaphthalene, etc.), and so on. As for the auxiliary solvents, organic solvents having a boiling point of from about 30° C. or more, preferably from 50° C. to about 160° C., can be used, with typical examples including ethyl acetate, butyl acetate, ethyl propionate, methyl ethyl ketone, cyclohexanone, 2-ethoxyethyl acetate, dimethylformamide, and so on.

Processes and effects of the latex dispersion method, and specific examples of latexes are described in, for example, U.S. Pat. No. 4,199,363, German Patent Application (OLS) Nos. 2,541,274 ad 2,541,363, and so on.

Silver halide emulsion which can be employed in the present invention include not only a silver chloride emulsion and a silver bromide emulsion but also mixed silver halide emulsions. Typical examples of mixed silver halides which can be used include silver chlorobromide, silver chloroiodobromide and silver iodobromide. Of these silver halides, silver chloroiodobromide, silver iodochloride, or silver iodobromide each having an iodide content of 3 mol % or less, silver chloride, silver bromide, and silver chlorobromide are more preferred.

The interior and the surface of the silver halide grain may differ, the silver halide grain may have such a multiphase structure as to have epitaxial faces, or the silver halide grain may be uniform throughout. The silver halide grains of the above-described kinds may be present as a mixture.

A mean grain size of the silver halide grains employed in the present invention (the grains size as used herein refers to a grain diameter in case of grains which are spherical or approximately spherical in shape, while it refers to an edge length in case of cubic grains, and in both cases, it is represented by a mean value based on the projected area of the grains) ranges preferably from 0.1 micron to 2 microns, particularly preferably from 0.15 micron to 1 micron. The distribution of the grain size may be either narrow or broad. In the present invention, a so-called monodispersed silver halide emulsion having a grain size distribution so narrow that at least 90%, preferably at least 95%, of the grains fall within the range of ±40% of the number or weight average grain size can be used. In order to satisfy the gradation aimed at by the light-sensitive material, monodispersed silver halide emulsions having substantially the same color sensitivity but differing in grain size can be coated in a single layer as a mixture, or they can be coated separately in multilayers. Also, two or more polydispersed silver halide emulsions or a combination of monodispersed and polydispersed emulsions may be coated as a mixture or separately in multilayers.

The silver halide grains to be employed in the present invention may have a regular crystal form such as that of a cube, an octahedron, a dodecahedron, or a tetradecahedron, or an irregular crystal form, such as that of the sphere or so on. Also, the grains may have a composite form of these crystal forms. Moreover, the grains may have a tabular form in which a grain diameter is greater than a grain thickness by a factor of 5 or more, particularly, 8 or more. Emulsions in which such tabular grains account for 50% or more of the total projected area of the grains may be employed in this invention. Emulsions which contain silver halide grains having various kinds of crystal forms as a mixture may be employed. These various kinds of emulsions may be either those which form a latent image predominantly at the surface of the grain (surface latent image type) or those which mainly form a latent image inside the grains (internal latent image type).

These photographic emulsions can be prepared using various methods as described, e.g., in P. Glafkides, *Chimie et Physique Photographique*, Paul Montel, Paris (1967), G. F. Duffin, *Photographic Emulsion Chemistry*, The Focal Press, London (1966), V. L. Zelikman et al, *Making and Coating Photographic Emulsion*, The Focal Press, London (1966), and so on. More specifically, any processes, e.g., the acid process, the neutral process, the ammoniacal process, and so on, can be employed.

Also, a method in which silver halide grains are produced in the presence of excess silver ions (the so-called reverse mixing method) can be employed. Moreover, the so-called controlled double jet method in which the pAg of the liquid phase where silver halide grains are to be precipitated is maintained constant may be employed. According to this method, silver halide emulsions having a regular crystal form and an almost uniform grain size can be obtained.

The emulsions used in the present invention are, in general, those that are subjected to physical ripening, chemical ripening and spectral sensitization. Additives used in these steps are described in *Research Disclosure*, No. 17643 and ibid., No. 18716, and the relevant parts therein are listed in the following Table.

Known photographic additives which can be used in the present invention are also described in the two *Research Disclosure* references, and the relevant parts therein are also listed in the following Table.

| Kind of Additives | RD 17643 | RD 18716 |
|---|---|---|
| 1. Chemical Sensitizers | Page 23 | Page 648, right column |
| 2. Sensitivity Increasing Agents | | Page 648, right column |
| 3. Spectral Sensitizers and Supersensitizers | Pages 23 to 24 | Page 648, right column to page 649, right column |
| 4. Whitening Agents | Page 24 | |
| 5. Antifoggants and Stabilizers | Pages 24 to 25 | Page 649, right column |
| 6. Light-Absorbers, Filter Dyes and Ultraviolet Light Absorbers | Pages 25 to 26 | Page 649, right column to page 650, left column |
| 7. Antistaining Agents | Page 25, right column | Page 650, left column to right column |
| 8. Dye Image Stabilizers | Page 25 | |
| 9. Hardeners | Page 26 | Page 651, left column |
| 10. Binders | Page 26 | Page 651, left column |
| 11. Plasticizers and Lubricants | Page 27 | Page 650, right column |
| 12. Coating Aids and Surfactants | Pages 26 to 27 | Page 650, right column |
| 13. Antistatic Agents | Page 27 | Page 650, right column |

Various color couplers may be used in the present invention, and specific examples thereof are described in the patent specifications referred to in the aforesaid *Research Disclosure*, No. 17643, VII-C through G. Important dye-forming couplers are those capable of forming three primary colors (of yellow, magenta, and cyan) in a subtractive color process by color development, and specific examples of non-diffusible four-equivalent or two-equivalent couplers which may be used in the present invention are described in the patent specifications referred to in *Research Disclosure*, No. 17643, VII-C and D. In addition, other couplers as mentioned below may also preferably be used in the present invention.

Typical examples of yellow couplers which may be used in the present invention are hydrophobic acylacetamide type couplers having a ballast group. Specific examples thereof are described, for example, in U.S. Pat. Nos. 2,407,210, 2,875,057, and 3,265,506. Two-equivalent yellow couplers are particularly preferably used in the present invention. Typical examples thereof are oxygen atom-releasing type yellow couplers as described in U.S. Pat. Nos. 3,408,194, 3,447,928, 3,933,501, and 4,022,620; and nitrogen atom-releasing type yellow couplers as described in JP-B-58-10739, U.S. Pat. Nos. 4,401,752 and 4,326,024, *Research Disclosure*, No. 18053 (April, 1979), British Patent 1,425,020, and German Patent Application (OLS) Nos. 2,219,917, 2,261,361, 2,329,587, and 2,433,812. α-Pivaloylacetanilide type couplers are good in fastness, especially to light, of the formed dyes; and, on the other hand, α-benzoylacetanilide type couplers are high in color density of the formed dyes.

Magenta couplers which may be used in combination with the pyrazoloazole type coupler in the present invention are ballast group-containing hydrophobic indazolone type or cyanoacetyl type couplers, preferably 5-pyrazolone type or pyrazoloazole type couplers. Among the 5-pyrazolone type couplers, those whose 3-position is substituted by an arylamino group or an acylamino group are preferred because of hue and color density of the formed dyes. Typical examples of these couplers are described in U.S. Pat. Nos. 2,311,082, 2,343,703, 2,600,788, 2,908,573, 3,062,653, 3,152,896, and 3,936,015. Regarding the split off group of the two-equivalent 5-pyrazolone type couplers, nitrogen atom-releasing groups as described in U.S. Pat. No. 4,310,619 and arylthio groups as described in U.S. Pat. No. 4,351,897 are especially preferred. In addition, ballast group-containing 5-pyrazolone type couplers as described in European Patent 73,636 are preferred because they provide a high color density.

As cyan couplers which can be used in the present invention, hydrophobic and diffusion-resistant naphthol type and phenol type couplers are exemplified. Typical examples thereof include naphthol type couplers as described in U.S. Pat. No. 2,474,293 and preferably oxygen atom-releasing type two-equivalent naphthol type couplers as described in U.S. Pat. Nos. 4,052,212, 4,146,396, 4,228,233 and 4,296,200, etc. Specific examples of phenol type couplers are described in U.S. Pat. Nos. 2,369,929, 2,801,171, 2,772,162 and 2,895,826, etc.

Cyan couplers capable of forming cyan dyes fast to humidity and temperature are preferably used in the present invention. Typical examples thereof include phenol type cyan couplers having an alkyl group more than a methyl group at the meta-position of the phenol nucleus as described in U.S. Pat. No. 3,772,002, 2,5-diacylamino-substituted phenol type couplers as described in U.S. Pat. Nos. 2,772,162, 3,758,308, 4,126,396, 4,334,011 and 4,327,173, West German Patent Application (OLS) No. 3,329,729, and European Patent 121,365, etc., phenol type couplers having a phenylureido group at the 2-position thereof and an acylamino group at the 5-position thereof as described in U.S. Pat. Nos. 3,446,622, 4,333,999, 4,451,559 and 4,427,767, etc. Further, cyan couplers of the naphthol type having a sulfonamido group or an amido group, etc. at the 5-position thereof as described in JP-A-60-237448, JP-A-61-153640 and JP-A-61-145557 are also preferably employed in the present invention because of excellent fastness of color images formed therefrom.

Further, couplers capable of forming appropriately diffusible dyes can be used together in order to improve graininess. Specific examples of such types of magenta couplers are described in U.S. Pat. No. 4,366,237 and British Patent 2,125,570, etc. and those of yellow, magenta and cyan couplers are described in European Patent 96,570 and West German Patent Application (OLS) No. 3,234,533, etc.

Dye forming couplers and the above described special couplers may form polymers including dimers or more. Typical examples of polymerized dye forming couplers are described in U.S. Pat. Nos. 3,451,820 and 4,080,211, etc. Specific examples of polymerized magenta couplers are described in British Patent 2,102,173 and U.S. Pat. No. 4,367,282, etc.

Couplers capable of releasing a photographically useful residue during the course of coupling can also be employed preferably in the present invention. Specific examples of useful DIR couplers capable of releasing a development inhibitor are described in the patents cited in *Research Disclosure*, No. 17643 (December, 1978), "VII-F" as mentioned above.

The color photographic materials of the present invention may be developed by means of a conventional developing means as described, for example, in the aforesaid *Research Disclosure*, No. 17643, pp. 28–29 and ibid., No. 18716, page 651, from left-hand column to right-hand column.

After development and bleach-fixing or fixing, the color photographic light-sensitive material of the present invention is generally subjected to washing or stabilization.

The washing step is, in general, carried out using two or more tanks according to the countercurrent washing method for the purpose of saving water. As a typical example of the stabilizing step, mention may be made of a multistage countercurrent stabilization processing which is to be carried out in place of the washing step, as described in JP-A-57-8543. In the processing of the present invention, a countercurrent bath having 2 to 9 tanks is required. To the stabilizing bath used in the present invention are added various kinds of compounds in order to stabilize the developed images. Typical examples of such additives include various buffering agents for adjusting the pH of the film to a proper value (ranging, e.g., from 3 to 8), such as those prepared by combining properly acids and alkalis selecting from borates, metaborates, borax, phosphates, carbonates, potassium hydroxide, sodium hydroxide, aqueous ammonia, monocarboxylic acids, dicarboxylic acids, polycarboxylic acids, and the like, and formaldehyde. The stabilizing bath may further contain a water softener (e.g., inorganic phosphoric acids, aminopolycarboxylic acids, organic phosphoric acids, aminopolyphosphonic acids, phosphonocarboxylic acids, or so on), a fertilizer (e.g., benzisothiazolinone, isothiazolone, 4-thiazolinebenzimidazole, halogenated phenols, or so on), a surface active agent, a fluorescent whitening agent, a hardener, and other various kinds of additives, if desired. Two or more kinds of compounds may be used for the same purpose or different purposes.

In addition, it is desired that various ammonium salts such as ammonium chloride, ammonium nitrate, ammonium sulfate, ammonium phosphate, ammonium sulfite, ammonium thiosulfate, and the like are added to the stabilizing bath in order to control the pH of the processed film.

The present invention can be applied to various kinds of color photographic materials. Representatives of such materials are color negative films for general use or motion picture use, color reversal films for slide use or television use, color paper, color positive films, color reversal paper, and so on.

The present invention is illustrated in greater detail by reference to the following examples. However, the invention is not intended to be construed as being limited to these examples.

EXAMPLE 1

20 ml of tri(2-ethylhexyl) phosphate and 25 ml of ethyl acetate were added to 10 g of Coupler (6) as a magenta coupler, and the mixture was heated for dissolution. The solution was added to 100 ml of an aqueous solution containing 10 g of gelatin and 1.0 g of sodium dodecylbenzenesulfonate, followed by stirring at an elevated temperature to prepare a finely emulsified dispersion. The whole amount of the emulsion dispersion was added to 100 g of a silver chlorobromide emulsion having a bromide content of 50 mol % (containing 6.5 g of silver), and 10 ml of a 2% aqueous solution of 2,4-dihydroxy-6-chloro-s-triazine sodium salt was further added thereto as a hardener. The thus prepared composition was coated on a paper support laminated with polyethylene on both the sides thereof in such an amount that the silver coverage was 200 mg/m$^2$. A gelatin layer was provided on the coated layer to prepare a sample. This sample is referred to as Sample A.

Other emulsion dispersions were prepared in the same manner as described above except that the magenta coupler was replaced by 15.2 g of Coupler (8), 14.3 g of Coupler (15), and 10.0 g of Coupler (29), respectively and that the amount of tri(2-ethylhexyl) phosphate was altered to 19 ml, 17 ml, and 16 ml, respectively. These emulsion dispersions each was mixed with the same amount of the same silver chlorobromide emulsion as described above and coated on the same support at the same silver coverage as described above. The thus obtained samples were referred to as Sample B, Sample C, and Sample D, respectively.

In addition, a comparative sample was prepared in the same manner as described above except that 8.9 g of the following compound,

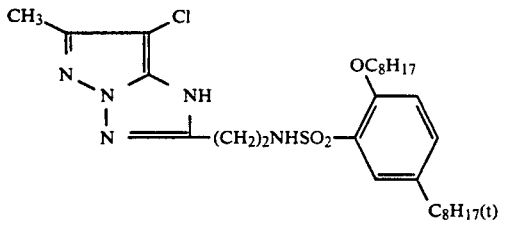

was used as the magenta coupler and the tri(2-ethylhexyl) phosphate was used in an amount of 18 ml instead of 20 ml.

Samples A to D and the comparative sample were subjected to 1000 C.M.S. wedge exposure and then processed using the following processing solutions.

| Developer | |
|---|---|
| Benzyl alcohol | 15 ml |
| Diethylenetriaminepentaacetic acid | 5 g |
| KBr | 0.4 g |
| $Na_2SO_3$ | 5 g |
| $Na_2CO_3$ | 30 g |
| Hydroxylamine sulfate | 2 g |
| 4-Amino-3-methyl-N-β-(methanesulfonamido)ethylaniline.3/2$H_2SO_4$.$H_2O$ | 4.5 g |
| Water to make | 1000 ml (pH 10.1) |
| **Bleach-Fixing Solution** | |
| Ammonium thiosulfate (70 wt %) | 150 ml |
| $Na_2SO_3$ | 5 g |
| Na[Fe(EDTA)] | 40 g |
| EDTA disodium salt | 5 g |
| Water to make | 1000 ml (pH 6.8) |

| Processing Steps | Temperature | Time |
|---|---|---|
| Development | 33° C. | 3 min. 30 sec. |
| Bleach-fixing | 33° C. | 1 min. 30 sec. |
| Washing | 28-35° C. | 3 min. |

Each of the thus processed samples provided a distinct magenta color image of high saturation. Photographic characteristics of these color images obtained were examined, and the results are shown below.

TABLE 1

| | Photographic Characteristics | | |
|---|---|---|---|
| Sample | Sensitivity* | Gradation | Maximum Density** (DM) |
| Comparative Sample | 100 | 2.92 | 2.94 |
| Sample A | 65 | 3.40 | 2.65 |
| Sample B | 70 | 3.35 | 2.63 |
| Sample C | 80 | 3.20 | 2.64 |
| Sample D | 68 | 3.30 | 2.66 |

*Relative value of an exposure required for providing a density of fog +0.5, taking the sensitivity of the comparative sample as 100.

**ε (molar extinction coefficient) of the dyes produced from the couplers of the present invention was about 50,000, which was smaller than that of the dye from the comparative coupler (ε ≈ 56,000) by about 10%. Consequently, Dm values of the present samples were less than that of the comparative sample which had the equimolar coverage with respect to coupler.

It can be seen from the above results that the couplers of the present invention are superior in both sensitivity and gradation to the coupler having an alkyl group at the 6-position. This is attributable to introduction of an alkoxy group or an aryloxy group at the 6-position, whereby the coupling activity is enhanced and the color-forming efficiency is improved.

EXAMPLE 2

As described in Table 2, a first layer (undermost layer) to a seventh layer (uppermost layer) were coated in sequence on a paper support laminated with polyethylene on both sides thereof to prepare color photographic materials E, F and G.

The coating compositions used for forming each third layer in which an emulsion dispersion of magenta coupler and a silver halide emulsion were contained were prepared in the same manner as in Example 1.

TABLE 2

| | |
|---|---|
| Support | Paper support laminated with polyethylene on both sides thereof |
| 1st Layer | Blue-sensitive silver chlorobromide emulsion (Br content: 80 mol %, Ag coverage: 350 mg/m$^2$), Gelatin (coverage: 1500 mg/m$^2$), Yellow coupler (*1) (coverage: 500 mg/m$^2$), Solvent (*2) (coverage: 400 mg/m$^2$) |
| 2nd Layer | Gelatin (coverage: 1100 mg/m$^2$), Color-mixing inhibitor (*3) (coverage: 200 mg/m$^2$), Solvent (*4) (coverage: 100 mg/m$^2$) |
| 3rd Layer | Green-sensitive silver chlorobromide emulsion (Br content: 50 mol %, Ag coverage: 180 mg/m$^2$), Magenta coupler (*5) (coverage: $3.4 \times 10^{-4}$ mole/m$^2$), Solvent (*6) (coverage: 510 mg/m$^2$ in Sample E, 480 mg/m$^2$ in Sample F, and 410 mg/m$^2$ in Sample G) |
| 4th Layer | Gelatin (coverage: 1600 mg/m$^2$), UV light absorbent (*7) (coverage: 700 mg/m$^2$), Color-mixing inhibitor (*3) (coverage: 200 mg/m$^2$), Solvent (*4) (coverage: 300 mg/m$^2$) |
| 5th Layer | Red-sensitive silver chlorobromide emulsion (Br content: 50 mol %, Ag coverage: 300 mg/m$^2$), Gelatin (coverage: 1200 mg/m$^2$), Cyan coupler (*8) (coverage: 400 mg/m$^2$), Solvent (*4) (coverage: 250 mg/m$^2$) |
| 6th Layer | Gelatin (coverage: 1000 mg/m$^2$), UV light absorbent (*7) coverage: 360 mg/m$^2$), Solvent (*4) (coverage: 120 mg/m$^2$) |
| 7th Layer | Gelatin (coverage: 1600 mg/m$^2$) |

*1 Yellow coupler: α-Pivaloyl-α-(2,4-dioxo-5,5'-di-methyloxazolidine-3-yl)-2-chloro-5-[α-(2,4-di-tert-pentylphenoxy)butanamido]acetanilide
*2 Solvent: Dioctylbutyl phosphate
*3 Color-mixing inhibitor: 2,5 Dioctylhydroquinone
*4 Solvent: Dibutyl phthalate
*5 Magenta coupler:
Sample E, Coupler (6)
Sample F, Coupler (15)
Sample G, Comparative compound used in Example 1
*6 Solvent Tri(2-ethylhexyl) phosphate
*7 UV light absorbent: 2-(2-Hydroxy-3-sec-butyl-5-tert-butylphenyl)benzotriazole
*8 Cyan coupler: 2-[α-(2,4-Di-tert-pentylphenoxy)-butanamido]-4,6-dichloro-5-methylphenol These Samples E, F and G were exposed in the same manner as in Example 1 through a B-G-R three-color separation filter and then processed in the same manner as in Example 1 except that color development time employed was 2 minutes, 3 minutes and 30 seconds, or 6 minutes.

Changes in photographic characteristics caused by changing the color development time are shown in Table 3.

TABLE 3

| | Photographic Characteristics | | | | | | | | |
|---|---|---|---|---|---|---|---|---|---|
| | Sensitivity | | | Gradation (γ) | | | Max. Density (Dm) | | |
| | 2' | 3'30" | 6' | 2' | 3'30" | 6' | 2' | 3'30" | 6' |
| Sample E (6) | 80 | 66 | 62 | 3.28 | 3.30 | 3.29 | 2.25 | 2.29 | 2.29 |
| Sample F (15) | 90 | 82 | 76 | 3.12 | 3.15 | 3.14 | 2.23 | 2.28 | 2.27 |
| Sample G (Comparative Compound) | 126 | 100 | 83 | 2.62 | 2.81 | 2.79 | 2.50 | 2.63 | 2.64 |

*Relative value of an exposure required for providing a density of fog +0.5, taking the sensitivity of Sample G attained by 3.5 minutes' development as 100.

The foregoing data show that in the multilayered multicolor photographic material, less dependence of development time upon sensitivity, gradation and maximum density was observed in the samples containing the couplers of the present invention as compared with the sample containing the coupler of 6-positioned methyl type. That is, the couplers of the present invention can contribute to attainment of photographic characteristics with less fluctuation by short-time development. High activity and high color-forming efficiency of which the couplers of the present invention are possessed as compared with those of conventional pyrazoloazole couplers are advantageous in designing photographic materials. Thus, the couplers of the present invention are found to have excellent properties.

EXAMPLE 3

20 ml of tri(2-ethylhexyl) phosphate and 25 ml of ethyl acetate were added to 10.0 g (16.8 mmole) of Coupler (6) as a magenta coupler, and the mixture was heated for dissolution. The solution was added to 100 ml of an aqueous solution containing 10 g of gelatin and 1.0 g of sodium dodecylbenzenesulfonate, followed by stirring at an elevated temperature to prepare a finely emulsified dispersion. The whole amount of the emulsion dispersion was added to 100 g of a silver chlorobromide emulsion having a bromide content of 30 mol % (containing 6.5 g of silver), and 10 ml of a 2% aqueous solution of 2,4-dihydroxy-6-chloro-s-triazine sodium salt was further added thereto as a hardener. The thus prepared composition was coated on a paper support laminated with polyethylene on both the sides thereof in such an amount that the silver coverage was 200 mg/m$^2$. A gelatin layer was provided on the coated layer to prepare a sample. This sample is referred to as Sample I-(A).

Other emulsion dispersions were prepared in the same manner as described above except that the magenta coupler was replaced by an equimolar amount of each of Couplers (8), (10), (17), (26), (28), (30), (31), (36), (37), (42), (44), (45), (49), and (51), respectively. Each of these emulsion dispersions was mixed with the same amount of the same silver chlorobromide emulsion as described above and coated on the same support at the same silver coverage as described above. The thus obtained samples were referred to as Sample I-(B) to I-(O), respectively.

In addition, Comparative Sample (1) was prepared in the same manner as described above except that 8.9 g (16.8 mmole) of the following Comparative Compound (1):

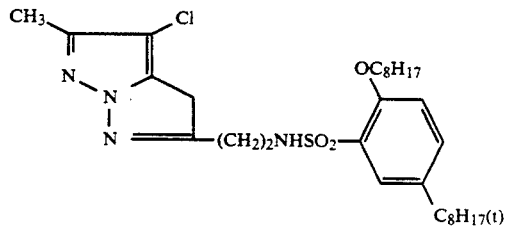

(described in European Patent 176,804A) was used as the magenta coupler and that tri(2-ethylhexyl) phosphate was used in an amount of 18 ml instead of 20 ml.

In a similar manner, another Comparative Sample (2) was prepared using 8.9 g of the following Comparative Compound (2):

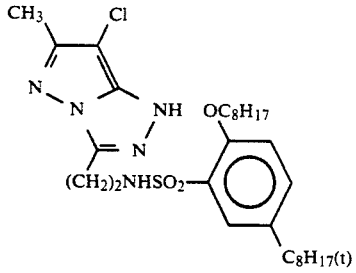

(described in European Patent 176,804A)

These Samples I-(A) to I-(O) and the Comparative Samples (1) and (2) were subjected to 1000 C.M.S. wedge exposure and then processed using the following processing solutions.

| Developer | |
|---|---|
| Benzyl alcohol | 15 ml |
| Diethylenetriaminepentaacetic acid | 5 g |
| KBr | 0.4 g |
| $Na_2SO_3$ | 3 g |
| $Na_2CO_3$ | 30 g |
| Hydroxylamine sulfate | 2 g |
| 4-Amino-3-methyl-N-β-(methanesulfonamido)ethylaniline.3/2$H_2SO_4$.$H_2O$ | 4.5 g |
| Water to make | 1000 ml (pH 10.1) |
| **Bleach-Fixing Solution** | |
| Ammonium thiosulfate (70 wt %) | 150 ml |
| $Na_2SO_3$ | 5 g |
| Na[Fe(EDTA)] | 40 g |
| EDTA disodium salt | 5 g |
| Water to make | 1000 ml (pH 6.8) |

| Processing Steps | Temperature | Time |
|---|---|---|
| Development | 33° C. | 3 min. 30 sec. |
| Bleach-fixing | 33° C. | 1 min. 30 sec. |

-continued

| | | |
|---|---|---|
| Washing | 28-35° C. | 3 min. |

Each of the thus processed samples provided a distinct magenta color image of high saturation. Photographic characteristics of these color images obtained were examined, and the results are shown below.

TABLE 4

| Sample | Photographic Characteristics | | |
|---|---|---|---|
| | Sensitivity* | Gradation (γ) | Maximum Density** (DM) |
| Comparative Sample (1) | 100 | 2.92 | 2.75 |
| Comparative Sample (2) | 98 | 2.88 | 2.74 |
| I-(A) | 120 | 3.39 | 2.76 |
| I-(B) | 115 | 3.36 | 2.82 |
| I-(C) | 116 | 3.45 | 2.85 |
| I-(D) | 118 | 3.38 | 2.76 |
| I-(E) | 109 | 3.20 | 2.78 |
| I-(F) | 108 | 3.10 | 2.76 |
| I-(G) | 108 | 3.15 | 2.82 |
| I-(H) | 107 | 3.12 | 2.90 |
| I-(I) | 113 | 3.38 | 2.77 |
| I-(J) | 114 | 3.42 | 2.76 |
| I-(K) | 109 | 3.00 | 2.78 |
| I-(L) | 110 | 3.32 | 2.79 |
| I-(M) | 108 | 3.01 | 2.80 |
| I-(N) | 111 | 3.05 | 2.80 |
| I-(O) | 112 | 3.08 | 2.77 |

I*Relative value, taking the sensitivity of Comparative Sample (1) obtained by 3.5 minutes' color development as 100.

**Gamma, obtained as a slope of the characteristic curve in the straight line portion corresponding to the density range of from 0.6 to 2.5.

In analogy with Example 1, it can be seen from the foregoing data that the couplers of the present invention have more excellent effects upon any of sensitivity, gradation and color density of the developed image as compared with the coupler having an alkyl group at the 6-position.

EXAMPLE 4

On a paper support laminated with polyethylene on both sides thereof were coated the layers described in Table 5 to prepare a multilayered multicolor photographic printing paper. The coating compositions used were prepared in the following manners.

Preparation of coating composition for first layer:

10 g of a yellow coupler (a) and 2.1 g of a color image stabilizer (b) were added to and dissolved in a mixture of 10 ml of ethyl acetate and 4.0 ml of a solvent (c). The solution was emulsified and dispersed into 90 ml of a 10% aqueous gelatin solution containing 10 ml of 1% sodium dodecylbenzenesulfonate. Separately, 95 g of a blue-sensitive emulsion was prepared by adding a blue-sensitive dye illustrated below to a silver chlorobromide emulsion (having a bromide content of 50 mol % and containing Ag in an amount of 70 g per kg of the emulsion) in an amount of $2.25\times10^{-4}$ mole per mole of silver chlorobromide. The emulsion dispersion and the silver chlorobromide emulsion were mixed with each other, and gelatin was further added thereto in such an amount as to adjust concentrations of the ingredients to values set forth in Table 5. Thus, a coating composition for the first layer was prepared.

Coating compositions for the second to seventh layers were prepared in a similar manner as described above. In each layer, 1-oxy-3,5-dichloro-s-triazine sodium salt was used as a gelatin hardener.

Spectral sensitizers employed in the respective emulsion layers are illustrated below.

Blue-Sensitive Emulsion Layer:

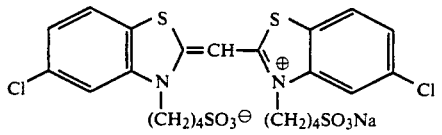

Green-Sensitive Emulsion Layer:

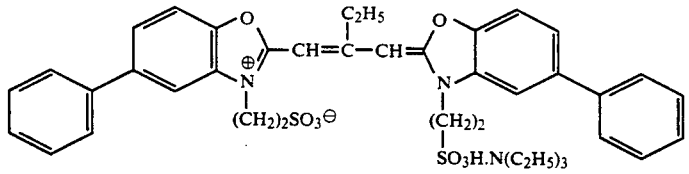

Red-Sensitive Emulsion Layer:

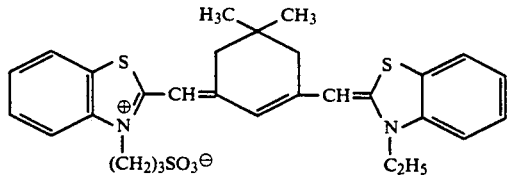

The following dyes were incorporated in the emulsion layers as their respective irradiation preventing dyes.

Green-Sensitive Emulsion Layer:

-continued
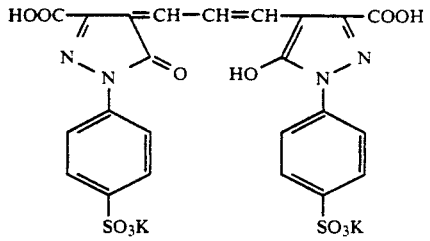
Red-Sensitive Emulsion Layer:
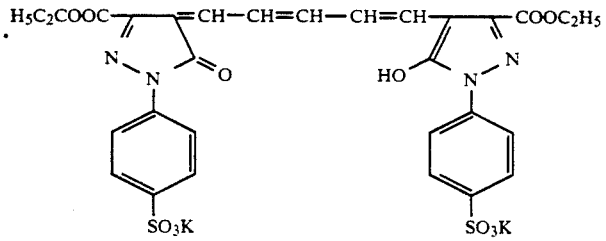
The structural formulae of the compounds employed in this example including couplers are illustrated below.
(a) Yellow Coupler
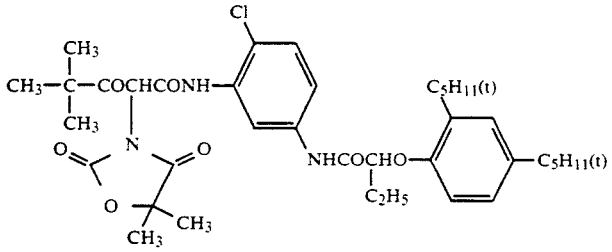
(b) Color Image Stabilizer
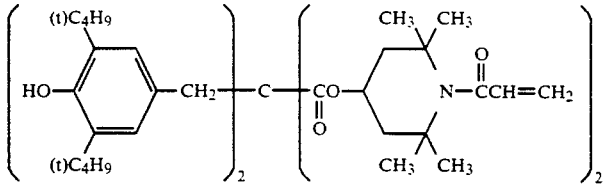
(c) Solvent
$(C_9H_{19}\phi)_3P{=}O$
(d) Color-Mixing Preventing Agent
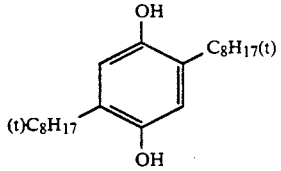
(e) Solvent
1:1 (by mole) mixture of 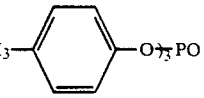 and 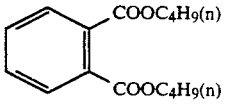
(f) UV Light Absorbent
1:5:3 (by mole) mixture of -continued

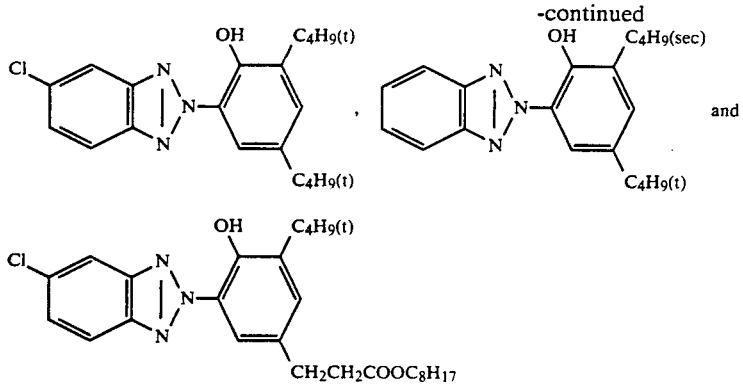

(g) Cyan Coupler

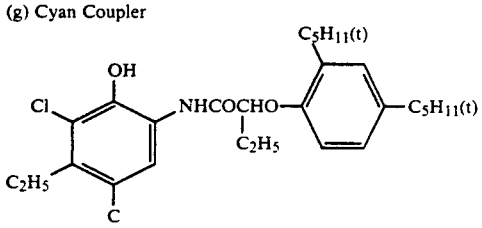

(h) Color Image Stabilizer
1:3:3 (by mole) mixture of

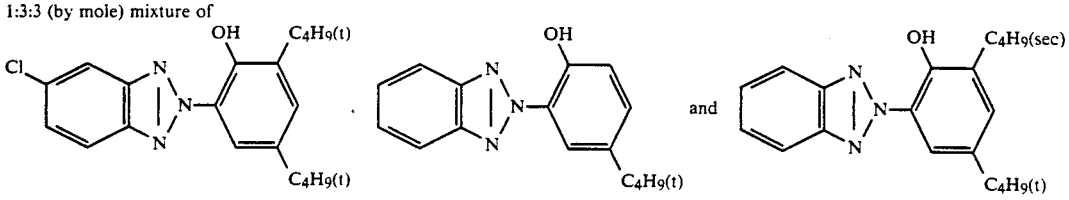

(i) Solvent
1:2 (by mole) mixture of

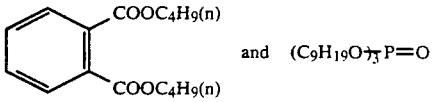

TABLE 5

| Layer | Main Ingredients | Amount Used |
|---|---|---|
| 7th Layer (Protective Layer) | Gelatin | 1.33 g/m$^2$ |
| | Acrylic denatured polyvinyl alcohol polymer (denaturation degree: 17%) | 0.17 g/m$^2$ |
| 6th Layer (UV Light Absorbing Layer) | Gelatin | 0.62 g/m$^2$ |
| | UV light absorbent (f) | 5.10 × 10$^{-4}$ mole/m$^2$ |
| | Solvent (c) | 0.07 g/m$^2$ |
| 5th Layer (red-sensitive Layer) | Silver chlorobromide emulsion (bromide content: 95 mol %) | 0.22 g/m$^2$ as Ag |
| | Gelatin | 0.93 g/m$^2$ |
| | Cyan coupler (g) | 7.05 × 10$^{-4}$ mole/m$^2$ |
| | Color image stabilizer (h) | 5.20 × 10$^{-4}$ mole/m$^2$ |
| | Solvent (i) | 0.25 g/m$^2$ |
| 4th Layer (UV Light Absorbing Layer) | Gelatin | 1.43 g/m$^2$ |
| | UV light absorbent (f) | 1.50 × 10$^{-3}$ mole/m$^2$ |
| | Color-mixing preventing agent (d) | 1.50 × 10$^{-4}$ mole/m$^2$ |
| | Solvent (c) | 0.22 g/m$^2$ |
| 3rd Layer (Green-sensitive Layer) | Silver chlorobromide emulsion (bromide content: 70 mol %) | Shown in Table 6 |
| | Gelatin | |
| | Magenta coupler | |
| | Color image stabilizer (j) | |

TABLE 5-continued

| Layer | Main Ingredients | Amount Used |
|---|---|---|
| | Solvent (k) | |
| 2nd Layer (Color-Mixing Preventing Layer) | Gelatin | 0.92 g/m$^2$ |
| | Color-mixing preventing agent (d) | 2.33 × 10$^{-4}$ mole/m$^2$ |
| | Solvent (e) | 0.15 g/m$^2$ |
| 1st Layer (Blue-sensitive Layer) | Silver chlorobromide emulsion (bromide content: 50 mol %) | 0.26 g/m$^2$ as Ag |
| | Gelatin | 1.83 g/m$^2$ |
| | Yellow coupler (a) | 1.30 × 10$^{-3}$ mole/m$^2$ |
| | Color image stabilizer (b) | 2.06 × 10$^{-4}$ mole/m$^2$ |
| | Solvent (c) | 0.42 g/m$^2$ |
| Support | Polyethylene-laminated paper (containing a white pigment (like $TiO_2$) and a bluish pigment (like ultramarine) in the polyethylene laminated in the side of the first layer). | |

After balancing the surface tension and the viscosity of the coating compositions for forming the first to seventh layers, the compositions were simultaneously coated to prepare a multilayered silver halide color photographic material.

Various coating compositions for the third layer were prepared using the couplers represented by the formula (I) or (II) of the present invention and the comparative couplers as the magenta coupler and changing the formulation variously as shown in Table 6. Using these coating compositions respectively, multilayered color photographic materials were prepared and referred to as Samples II-A to II-N.

TABLE 6

| Sample | Silver ($g/m^2$) | Gelatin ($g/m^2$) | Kind of Coupler | Amount of Coupler Used ($g/m^2$) | Color Image Stabilizer ($g/m^2$) | Solvent (k) ($g/m^2$) | Solvent (l) ($g/m^2$) | Note |
|---|---|---|---|---|---|---|---|---|
| II-$A_1$ | 0.15 | 1.80 | (m) | $3.85 \times 10^{-4}$ | $3.85 \times 10^{-4}$ | 0.43 | 0.27 | ** |
| II-$A_2$ | " | " | (n) | " | " | " | " | ** |
| II-B | " | " | (6) | " | " | " | " | * |
| II-C | " | " | (8) | " | " | " | " | * |
| II-D | " | " | (10) | " | " | " | " | * |
| II-E | 0.19 | " | (m) | " | " | — | 0.35 | ** |
| II-F | " | " | (17) | " | " | — | " | * |
| II-G | " | " | (28) | " | " | 0.43 | 0.27 | * |
| II-H | " | " | (30) | " | " | " | " | * |
| II-I | " | " | (31) | " | " | " | " | * |
| II-J | 0.15 | " | (36) | " | " | " | " | * |
| II-K | " | " | (37) | " | " | " | " | * |
| II-L | " | " | (42) | " | " | " | " | * |
| II-M | " | " | (44) | " | " | " | " | * |
| II-N | 0.19 | " | (45) | " | " | — | " | * |

*Present invention
**Comparison (j) Color image stabilizer

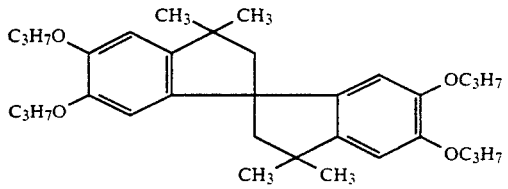

(k) Solvent $(C_8H_{17}O)_3P{=}O$ (l) Solvent

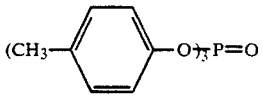

(m) Comparative coupler

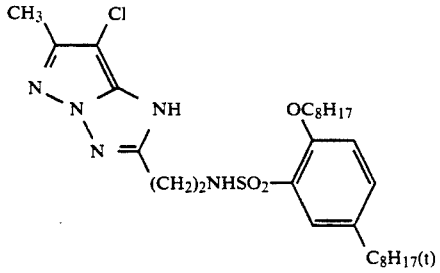

(described in European Patent 176,804A)

(n) Comparative coupler

-continued

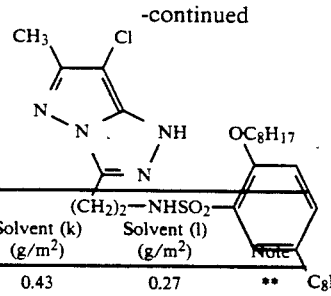

(described in European Patent 176,804A)

These silver halide color photographic materials were subjected to wedge exposure in a conventional manner and processed according to the following processing steps using processing solutions having formulations described below.

The thus obtained sensitometric samples were examined for photographic characteristics, and the results obtained are shown in Table 7.

| Processing Steps | Temperature | Time |
|---|---|---|
| Color Development | 33° C. | 1'30", 2'30", and 3'30" |
| Bleach-fixing | 33° C. | 1'30" |
| Washing | 33° C. | 3' |

Composition of Processing Solution:

(Color Developer)

| | |
|---|---|
| Water | 800 ml |
| Sodium tetrapolyphosphate | 2.0 g |
| Benzyl alcohol | 14.0 ml |
| Diethylene glycol | 10.0 ml |
| Sodium sulfite | 2.0 g |
| Potassium bromide | 0.5 g |
| Sodium carbonate | 30.0 g |
| N-Ethyl-N-(β-methanesulfonamidoethyl)-3-methyl-4-aminoaniline sulfonate | 5.0 g |
| Hydroxylamine sulfate | 4.0 g |
| Water to make | 1000 ml |
| pH (at 25° C.) | 10.20 |

(Bleach-fixing Solution)

| | |
|---|---|
| Water | 400 ml |
| Ammonium thiosulfate (70%) | 150 ml |
| Sodium sulfite | 18 g |
| Ammonium ethylenediaminetetra-acetatoferrate(III) | 55 g |
| Disodium ethylenediaminetetraacetate | 5 g |
| Water to make | 1000 ml |
| pH (at 25° C.) | 7.00 |

TABLE 7

| Sample | Photographic Characteristics | | | | | | | | |
|---|---|---|---|---|---|---|---|---|---|
| | Sensitivity | | | Gradation (γ) | | | Max. Density (Dm) | | |
| | 1'30" | 2'30" | 3'30" | 1'30" | 2'30" | 3'30" | 1'30" | 2'30" | 3'30" |
| II-$A_1$ | 100 | 110 | 120 | 2.22 | 2.24 | 2.26 | 2.35 | 2.45 | 2.51 |
| II-$A_2$ | 102 | 111 | 121 | 2.21 | 2.23 | 2.25 | 2.34 | 2.45 | 2.50 |
| II-B | 132 | 135 | 140 | 3.05 | 3.10 | 3.14 | 2.44 | 2.53 | 2.55 |
| II-C | 124 | 127 | 130 | 2.55 | 2.60 | 2.63 | 2.50 | 2.51 | 2.54 |
| II-D | 125 | 129 | 135 | 2.68 | 2.72 | 2.74 | 2.55 | 2.60 | 2.61 |
| II-E | 100 | 121 | 129 | 2.74 | 2.81 | 2.85 | 2.47 | 2.50 | 2.55 |
| II-F | 130 | 134 | 139 | 2.96 | 3.00 | 3.05 | 2.59 | 2.60 | 2.62 |
| II-G | 124 | 125 | 127 | 2.75 | 2.89 | 2.95 | 2.50 | 2.52 | 2.53 |
| II-H | 131 | 132 | 135 | 2.82 | 2.90 | 2.92 | 2.52 | 2.54 | 2.55 |
| II-I | 120 | 122 | 125 | 2.65 | 2.73 | 2.76 | 2.44 | 2.48 | 2.52 |
| II-J | 121 | 123 | 124 | 2.58 | 2.64 | 2.68 | 2.46 | 2.49 | 2.51 |
| II-K | 119 | 122 | 126 | 2.60 | 2.65 | 2.67 | 2.43 | 2.48 | 2.53 |
| II-L | 120 | 121 | 123 | 2.58 | 2.62 | 2.64 | 2.45 | 2.49 | 2.52 |
| II-M | 122 | 124 | 126 | 2.53 | 2.58 | 2.60 | 2.42 | 2.46 | 2.52 |
| II-N | 131 | 133 | 135 | 2.72 | 2.78 | 2.80 | 2.53 | 2.55 | 2.57 |

In the above table, the sensitivity is a relative value, taking the sensitivity of Sample II-$A_1$ and Sample E attained by 1.5 minutes' development as 100 (comparison was carried out using samples having the same volume). The gradation (γ) is expressed in terms of a slope of the characteristic curve in the straight line portion corresponding to the density range of from 0.6 to 2.0. The maximum density means a maximum density of magenta dye image.

As can be seen from the data set forth in Table 7, the samples using the coupler of the present invention, Samples II-B to II-D and II-F to II-N, had enhanced sensitivity and improved gradation (γ) and produced high color density of the developed image.

EXAMPLE 5

For the purpose of sensitometry evaluation, the samples prepared in Example 4, Samples II-A to II-N, were subjected to wedge exposure in a conventional manner and processed according to the following processing steps using processing solutions having formulations described below. The results obtained are shown in Table 8.

| Processing Steps | Temperature | Time |
|---|---|---|
| Color Development | 35° C. | 30", 45", and 1'30" |
| Bleach-fixing | 35° C. | 1'30" |
| Washing | 28–35° C. | 1'30" |

-continued

| Composition of Processing Solution: | |
|---|---|
| (Color Developer) | |
| Water | 800 ml |
| Diethylenetriaminepentaacetic acid | 1.0 g |
| Sodium sulfite | 0.2 g |
| N,N-Diethylhydroxylamine | 4.2 g |
| Potassium bromide | 0.6 g |
| Sodium chloride | 1.5 g |
| Triethanolamine | 8.0 g |
| Potassium carbonate | 30 g |
| N-Ethyl-N-(β-methanesulfonamidoethyl)-3-methyl-4-aminoaniline sulfonate | 4.5 g |
| Fluorescent whitening agent of 4,4'-diaminostilbene type (Whitex ®, made by Sumitomo Chemical Co., Ltd.) | 2.0 g |
| Water to make | 1000 ml |
| KOH to adjust pH to | 10.25 |
| (Bleach-fixing Solution) | |
| Ammonium thiosulfate (54%) | 150 ml |
| $Na_2SO_3$ | 15 g |
| $NH_4$[Fe(III)(EDTA)] | 55 g |
| EDTA.2Na | 4 g |
| Glacial acetic acid | 8.61 g |
| Water to make | 1000 ml (pH 5.4) |
| (Washing Solution) | |
| EDTA.2Na.$2H_2O$ | 0.4 g |
| Water to make | 1000 ml (pH 7.0) |

TABLE 8

| Sample | Photographic Characteristics | | | | | | | | |
|---|---|---|---|---|---|---|---|---|---|
| | Sensitivity | | | Gradation (γ) | | | Max. Density (Dm) | | |
| | 30" | 45" | 1'30" | 30" | 45" | 1'30" | 30" | 45" | 1'30" |
| II-$A_1$ | 100 | 119 | 132 | (1.22) | (1.68) | 2.03 | 1.28 | 1.75 | 2.12 |
| II-$A_2$ | 101 | 119 | 133 | (1.20) | (1.65) | 2.01 | 1.27 | 1.74 | 2.10 |
| II-B | 138 | 144 | 147 | (2.30) | 2.43 | 2.52 | 1.51 | 2.30 | 2.35 |
| II-C | 132 | 136 | 138 | (2.19) | 2.39 | 2.50 | 1.46 | 2.22 | 2.29 |
| II-D | 134 | 137 | 142 | (2.15) | 2.21 | 2.53 | 1.65 | 2.35 | 2.41 |
| II-E | 100 | 125 | 136 | (1.35) | (1.80) | 2.20 | 1.35 | 1.88 | 2.22 |
| II-F | 135 | 142 | 145 | (2.26) | 2.37 | 2.65 | 1.48 | 2.28 | 2.36 |
| II-G | 134 | 138 | 142 | (2.13) | 2.36 | 2.51 | 1.42 | 2.25 | 2.30 |
| II-H | 129 | 138 | 140 | (2.21) | 2.28 | 2.50 | 1.40 | 2.23 | 2.27 |
| II-I | 121 | 122 | 124 | (2.11) | 2.22 | 2.48 | 1.38 | 2.20 | 2.25 |
| II-J | 127 | 128 | 129 | (2.13) | 2.31 | 2.51 | 1.37 | 2.20 | 2.24 |
| II-K | 130 | 132 | 134 | (2.20) | 2.25 | 2.47 | 1.39 | 2.22 | 2.28 |
| II-L | 128 | 129 | 131 | (2.22) | 2.24 | 2.46 | 1.40 | 2.21 | 2.27 |
| II-M | 132 | 134 | 135 | (2.21) | 2.28 | 2.49 | 1.38 | 2.22 | 2.26 |
| II-N | 135 | 138 | 140 | (2.31) | 2.35 | 2.50 | 1.47 | 2.27 | 2.32 |

In the above table, the sensitivity is a relative value, taking the sensitivity of Sample II-$A_1$ and II-E attained by 30 seconds' development as 100. The gradation (γ) is expressed in terms of a slope of the characteristic curve in the straight line portion corresponding to the density range of from 0.6 to 2.0. Gamma values in parentheses are slopes of individual straight line portions because image densities did not go up to 2.0 under such conditions. The maximum density means a maximum density of magenta dye image.

As can be seen from the data set forth in Table 8, Samples II-B to II-D and II-F to II-N in which the couplers of the present invention were incorporated had enhanced sensitivity and improved gradation and provided high color density of the developed image.

EXAMPLE 6

On a paper support laminated with polyethylene on both the sides thereof were coated the layers described below, from the first layer to the twelfth layer, to prepare Sample III-$A_1$ and Sample III-$A_2$. Titanium white as a white pigment and a trace amount of ultramarine as a bluish pigment were incorporated in the polyethylene laminated in the side of the first layer.

Composition of Constituent Layers

Ingredients and their respective coverages expressed in terms of $g/m^2$ are described below. As for the silver halide, its coverage is based on silver.

| | |
|---|---|
| First Layer: Gelatin Layer | |
| Gelatin | 1.30 |
| Second Layer: Antihalation Layer | |
| Black colloidal silver | 0.10 |
| Gelatin | 0.70 |
| Third Layer: Red-sensitive Layer Having Low Sensitivity | |
| Silver iodobromide spectrally sensitized with red color sensitizing dyes (*1 and *2) (iodide content: 5.0 mol %, mean grain size 0.4 micron) | 0.15 |
| Gelatin | 1.00 |
| Cyan coupler (*3) | 0.14 |
| Cyan coupler (*4) | 0.07 |
| Color fade-preventing agent (*5, *6 and *7) | 0.10 |
| Coupler solvent (*8 and *9) | 0.60 |
| Fourth Layer: Red-sensitive Layer Having High Sensitivity | |
| Silver iodobromide spectrally sensitized with red color sensitizing dyes (*1 and *2) (iodide content: 6.0 mol %, mean grain size 0.7 micron) | 0.15 |
| Gelatin | 1.00 |
| Cyan coupler (*3) | 0.20 |
| Cyan coupler (*4) | 0.10 |
| Color fade-preventing agent (*5, *6 and *7) | 0.15 |
| Coupler solvent (*8 and *9) | 0.10 |
| Fifth Layer: Interlayer | |
| Magenta colloidal silver | 0.02 |
| Gelatin | 1.00 |
| Color-mixing preventing agent (*10) | 0.08 |
| Color-mixing preventing solvent *11 and *12) | 0.16 |
| Polymer latex (*13) | 0.10 |
| Sixth Layer: Green-sensitive Layer Having Low Sensitivity | |
| Silver iodobromide spectrally sensitized with green color sensitizing dyes (*14) (iodide content: 2.5 mol %, mean grain size 0.4 micron) | 0.10 |
| Gelatin | 0.80 |
| Magenta coupler (*15) | 0.10 |
| Color fade-preventing agent (*16) | 0.10 |
| Stain inhibitor (*17) | 0.01 |
| Stain inhibitor (*18) | 0.001 |
| Coupler solvent (*11 and *19) | 0.15 |
| Seventh Layer: Green-sensitive Layer Having High Sensitivity | |
| Silver iodobromide spectrally sensitized with green color sensitizing dyes (*14) (iodide content: 3.5 mol %, mean grain size 0.9 micron) | 0.10 |
| Gelatin | 0.80 |
| Magenta coupler (*15) | 0.10 |
| Color fade-preventing agent (*16) | 0.10 |
| Stain inhibitor (*17) | 0.01 |
| Stain inhibitor (*18) | 0.001 |
| Coupler solvent (*11 and *19) | 0.15 |
| Eighth Layer: Yellow Filter Layer | |
| Yellow colloidal silver | 0.20 |
| Gelatin | 1.00 |
| Color-mixing preventing agent (*10) | 0.06 |
| Color-mixing preventing solvent *11 and *12) | 0.15 |
| Polymer latex (*13) | 0.10 |
| Ninth Layer: Blue-sensitive Layer Having Low Sensitivity | |
| Silver iodobromide spectrally sensitized with blue color sensitizing dyes (*20) (iodide content: 2.5 mol %, mean grain size 0.5 micron) | 0.15 |
| Gelatin | 0.50 |
| Yellow coupler (*21) | 0.20 |
| Stain inhibitor (*18) | 0.001 |
| Coupler solvent (*9) | 0.05 |
| Tenth Layer: Blue-sensitive Layer Having High Sensitivity | |
| Silver iodobromide spectrally sensitized with blue color sensitizing dyes (*20) (iodide content: 2.5 mol %, mean grain size 1.2 micron) | 0.25 |
| Gelatin | 1.00 |
| Yellow coupler (*21) | 0.40 |
| Stain inhibitor (*18) | 0.002 |
| Coupler solvent (*9) | 0.10 |
| Eleventh Layer: UV Light Absorbing Layer | |
| Gelatin | 1.50 |
| UV light absorbent (*22, *6 and *7) | 1.00 |
| Color-mixing preventing agent (*23) | 0.06 |
| Color-mixing preventing solvent (*9) | 0.15 |
| Irradiation preventing dye (*24) | 0.92 |
| Irradiation preventing dye (*25) | 0.02 |
| Twelfth Layer: Protective Layer | |
| Fine grain silver chlorobromide (chloride content: 97 mol %, mean grain size: 0.2 micron) | 0.07 |
| Gelatin | 1.50 |
| Gelatin hardener (*26) | 0.17 |

*1: 5,5'-Dichloro-3,3'-di(3-sulfobutyl)-9-ethylthiacarbonylcyanine sodium salt
*2: Triethylammonium-3-[2-{2-[3-(3-sulfopropyl)naphtho-(1,2-d)thiazoline-2-indenemethyl]-1-butenyl}-3-naphtho(1,2-d)thiazolino]propanesulfonate
*3: 2-[α-(2,4-di-t-amylphenoxy)hexanamido]-4,6-dichloro-5-ethylphenol
*4: 2-[2-Chlorobenzoylamino]-4-chloro-5-[α-(2-chloro-4-t-amylphenoxy)octanamido]phenol
*5: 2-(2-Hydroxy-3-sec-5-t-butylphenyl)benzotriazole
*6: 2-(2-Hydroxy-5-t-butylphenyl)benzotriazole
*7: 2-(2-Hydroxy-3,5-di-t-butylphenyl)-6-chlorobenzotriazole
*8: Dioctyl phthalate
*9: Trinonyl phosphate
*10: 2,5-Di-t-octylhydroquinone
*11: Tricresyl phosphate
*12: Dibutyl phthalate
*13: Polyethyl acrylate
*14: 5,5'-Diphenyl-9-ethyl-3,3'-disulfopropyloxacarbocyanine sodium salt
*15: Comparative Coupler (I) (in Sample III-$A_1$)

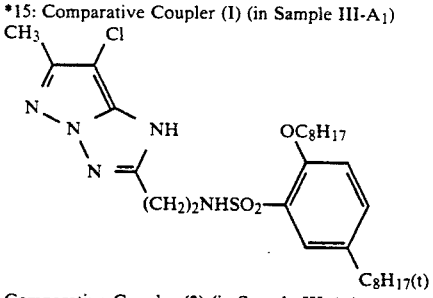

Comparative Coupler (2) (in Sample III-$A_2$)

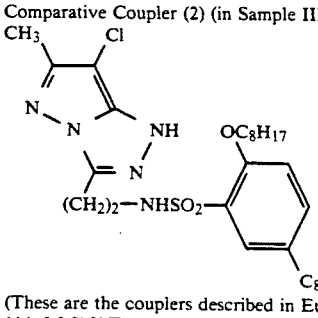

(These are the couplers described in European Patent 176,804A.)
*16: 3,3,3',3'-Tetramethyl-5,6,5',6'-tetrapropoxy-1,1'-bis-spiroindane
*17: 3-(2-Ethylhexyloxycarbonyloxy)-1-(3-hexadecyloxy- -continued phenyl)-2-pyrazoline
*18: 2-Methyl-5-t-octylhydroquinone
*19: Trioctyl phosphate
*20: Triethylammonium-3-[2-(3-benzylrhodanine-5-ylidene)-3-benzoxazolynyl]propanesulfonate
*21: α-Pivalyol-α-[(2,4-dioxo-1-benzyl-5-ethoxy-hydantoin-3-yl)-2-chloro-5-(α-2,4-di-5-amyl-phenoxy)tubanamido]acetanilide
*22: 5-Chloro-2-(2-hydroxy-3-t-butyl-5-t-octyl)phenyl-benzotriazole
*23: 2,5-Di-sec-octylhydroquinone

*24:

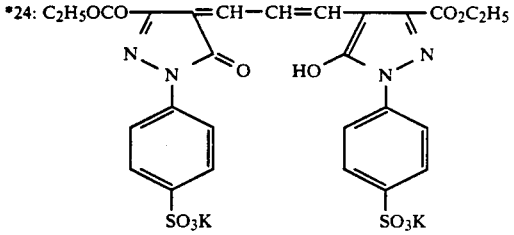

*25:

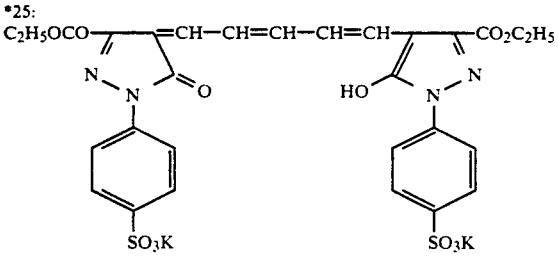

*26: 1,4-Bis(vinylsulfonylacetamido)ethane

Samples III-B to III-N were prepared in the same manner as in Sample III-$A_1$ or III-$A_2$ except that the comparative magenta coupler (*15) was replaced by an equimolar amount of each of Couplers (6), (8), (10), (17), (26), (28), (30), (31), (36), (37), (42), (44), and (45), respectively. These Samples III-A to III-N were subjected to wedge exposure in a conventional manner and then processed according to the following processing steps using processing solutions having the formulations described below.

The thus obtained sensitometric samples were examined for photographic characteristics, and the results obtained are shown in Table 9.

| Processing Steps | Temperature | Time |
|---|---|---|
| First Development (Black-and-white development) | 38° C. | 75 sec. |
| Washing | 38° C. | 90 sec. |
| Reversal Exposure | above 100 lux, | above 60 sec. |
| Color Development | 38° C. | 135 sec. |
| Washing | 38° C. | 45 sec. |
| Bleach-Fixing | 38° C. | 120 sec. |
| Washing | 38° C. | 135 sec. |
| Drying | | |

Composition of Processing Solution:

| | |
|---|---|
| (First developer) | |
| Pentasodium nitrilo-N,N,N trimethylene-phosphonate | 0.6 g |
| Pentasodium diethylenetriaminepenta-acetate | 4.0 g |
| Potassium sulfite | 30.0 g |
| Potassium thiocyanate | 1.2 g |
| Potassium carbonate | 35.0 g |
| Potassium hydroquinonemonosulfonate | 25.0 g |
| Diethylene glycol | 15.0 ml |
| 1-Phenyl-4-hydroxymethyl-4-methyl-3-pyrazolidone | 2.0 g |
| Potassium bromide | 0.5 g |

-continued

| | |
|---|---|
| Potassium iodide | 5.0 mg |
| Water to make | 1000 ml (pH 9.70) |
| (Color developer) | |
| Benzyl alcohol | 15.0 ml |
| Diethylene glycol | 12.0 ml |
| 3,6-Dithia-1,8-octanediol | 0.2 g |
| Pentasodium nitrilo-N,N,N-trimethylene-phosphonate | 0.5 g |
| Pentasodium diethylenetriaminepenta-acetic acid | 2.0 g |
| Sodium sulfite | 2.0 g |
| Potassium carbonate | 25.0 g |
| Hydroxylamine sulfate | 3.0 g |
| N-Ethyl-N-(β-methanesulfonamidoethyl)-3-methyl-4-aminoaniline sulfate | 5.0 g |
| Potassium bromide | 0.5 g |
| Potassium iodide | 1.0 mg |
| Water to make | 1000 ml (pH 10.40) |
| (Bleach-fixing Solution) | |
| 2-Mercapto-1,3,4-triazole | 1.0 g |
| Disodium ethylenediaminetetraacetate dihydrate | 5.0 g |
| Ammonium ethylenediaminetetraaceto-ferrate(III) monohydrate | 80.0 g |
| Sodium sulfite | 15.0 g |
| Sodium thiosulfate (700 g/l soln.) | 160.0 ml |
| Glacial acetic acid | 5.0 ml |
| Water to make | 1000 ml (pH 6.50) |

TABLE 9

| | Photographic Characteristics | | |
|---|---|---|---|
| Sample | Coupler | Gradation (γ) | Maximum Density** (Dm) |
| III-$A_1$ | Comparative Coupler (1) | 2.27 | 2.50 |
| III-$A_2$ | Comparative Coupler (2) | 2.26 | 2.48 |
| III-B | (6) | 2.56 | 2.63 |
| III-C | (8) | 2.55 | 2.64 |
| III-D | (10) | 2.54 | 2.62 |
| III-E | (17) | 2.46 | 2.60 |
| III-F | (26) | 2.45 | 2.59 |
| III-G | (28) | 2.47 | 2.58 |
| III H | (30) | 2.50 | 2.60 |
| III-I | (31) | 2.51 | 2.59 |
| III-J | (36) | 2.47 | 2.61 |
| III-K | (37) | 2.46 | 2.53 |
| III-L | (42) | 2.41 | 2.57 |
| III-M | (44) | 2.52 | 2.61 |
| III-N | (45) | 2.43 | 2.58 |

*The gradation (γ) is a slope of the characteristic curve in the straight line portion corresponding to the density range of 0.6 to 2.0.
**The maximum density means a maximum density of magenta dye image.

As can be seen from the data shown in the above table, Samples III-B to III-N in which the couplers of the present invention are employed had improved gradation (γ) and produced high color density of the developed image.

EXAMPLE 7

On a triacetate film support were coated the following first to thirteenth layers in this order to prepare Samples IV-$A_1$ and IV-$A_2$.

First Layer: Antihalation Layer 15 g of 5-chloro-2-(2-hydroxy-3,5-di-t-butylphenyl)-2H-benzotriazole, 30 g of 2-(2-hydroxy-5-t-butylphenyl)-2H-benzotriazole, 35 g of 2-(2-hydroxy-3-sec-butyl-5-t-butylphenyl)-2H-benzotriazole, and 100 g of dodecyl 5-(N,N-diethylamino)-2-benzenesulfonyl-2,4-pentadienoate, which are UV light absorbents, 200 ml of tricresyl phosphate, 200 ml of ethyl acetate, 20 g of sodium dodecylbenzenesulfonate, and a 10% gelatin aqueous solution were stirred at a high speed to prepare an emulsion (referred to as Emulsion (a)). This emulsion was mixed with 10% gelatin, black colloidal silver, water, and coating aids, and the mixture was coated in a dry thickness of 2 microns.

Second Layer: Gelatin Interlayer 2,5-Di-t-octylhydroquinone was dissolved in a mixture of 100 ml of dibutyl phthalate and 100 ml of ethyl acetate. The solution and 1 kg of a 10% gelatin aqueous solution were stirred at a high speed to prepare an emulsion (referred to as Emulsion (b)). A 2 kg portion of Emulsion (b) was mixed with a 1.5 kg portion of 10% gelatin, and the mixture was coated in a dry thickness of 1 micron.

Third Layer: Red-sensitive Emulsion Layer Having Low Sensitivity 10.0 g of 2-(heptafluorobutylamino)-5-[2'-(2'',4''-di-t-aminophenoxy)butylamino]phenol (cyan coupler) was dissolved in a mixture of 100 ml of tricresyl phosphate and 100 ml of ethyl acetate, and the solution was mixed with 1 kg of a 10% gelatin aqueous solution with high-speed stirring to prepare an emulsion (referred to as Emulsion (c)). A 500 g portion of Emulsion (c) was mixed with a 1 kg portion of a red-sensitive silver iodobromide emulsion (containing 70 g of silver and 60 g of gelatin and having an iodide content of 4 mol %). The mixture was coated in a dry thickness of 1 micron (silver coverage: 0.5 g/m$^2$).

Fourth Layer: Red-sensitive Emulsion Layer Having High Sensitivity

Emulsion (c) was mixed with a 1 kg portion of a red-sensitive silver iodobromide emulsion (containing 70 g of silver and 60 g of gelatin and having an iodide content of 2.5 mol %), and the mixture was coated in a dry thickness of 2.5 microns (silver coverage: 0.8 g/m$^2$).

Fifth Layer: Interlayer

Emulsion (b) was mixed with a 1 kg portion of 10% gelatin, and the mixture was coated in a dry thickness of 1 micron.

Sixth Layer: Green-sensitive emulsion Layer Having Low Sensitivity

An emulsion was prepared in the same manner as the emulsion for the 3rd layer except that Comparative Magenta Coupler (1) (in Sample IV-A$_1$) or Comparative Magenta Coupler (2) (in Sample IV-A$_2$) was used in place of the cyan coupler. This emulsion was referred to as Emulsion (d).

Comparative Magenta Coupler (1)

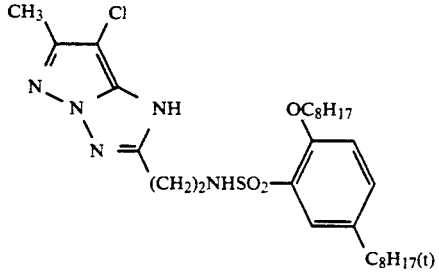

Comparative Magenta Coupler (2)

-continued

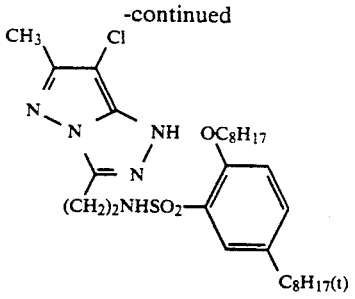

(These couplers are described in European Patent 176,804A).

A 300 g portion of Emulsion (d) was mixed with a 1 kg portion of a green-sensitive silver iodobromide emulsion (containing 70 g of silver and 60 g of gelatin and having an iodide content of 3 mol %), and the mixture was coated in a dry thickness of 2.0 microns (silver coverage: 0.7 g/m$^2$).

Seventh Layer: Green-sensitive Emulsion Layer Having High Sensitivity

A 1000 g portion of Emulsion (d) was mixed with a 1 kg portion of a green-sensitive silver iodobromide emulsion (containing 70 g of silver and 60 g of gelatin and having an iodide content of 2.5 mol %), and the mixture was coated in a dry thickness of 2.0 microns (silver coverage: 0.7 g/m$^2$).

Eighth Layer: Gelatin Interlayer

A 1 kg portion of Emulsion (b) was mixed with a 1 kg portion of 10% gelatin, and the mixture was coated in a dry thickness of 0.5 micron.

Ninth Layer: Yellow Filter Layer

An emulsion containing yellow colloidal silver was coated in a dry thickness of 1 micron.

Tenth Layer: Blue-sensitive Emulsion Layer Having Low Sensitivity

A 1000 g portion of an emulsion which had been prepared in the same manner as the emulsion for the 3rd layer except that an yellow coupler, α-(pivaloyl)-α-(1-benzyl-5-ethoxy-3-hydantoinyl)-2-chloro-5-dodecyloxycarbonylacetoanilide was employed in place of the cyan coupler, which is referred to as Emulsion (e), was mixed with a 1 kg portion of a blue-sensitive silver iodobromide emulsion (containing 70 g of silver and 60 g of gelatin and having an iodide content of 2.5 mol %), and the mixture was coated in a dry thickness of 1.5 microns (silver coverage: 0.6 g/m$^2$).

Eleventh Layer: Blue-sensitive Emulsion Layer Having High Sensitivity

A 1000 g portion of Emulsion (e) was mixed with a 1 kg portion of a blue-sensitive silver iodobromide emulsion (containing 70 g of silver and 60 g of gelatin and having iodide content of 2.5 mol %), and the mixture was coated in a dry thickness of 3 microns (silver coverage: 1.1 g/m$^2$).

Twelfth Layer: Second Protective Layer

Emulsion (a) wa mixed with 10% gelatin and coating aids, and the mixture was coated in a dry thickness of 2 microns.

Thirteenth Layer: First Protective Layer

A 10% gelatin aqueous solution containing a fine grain emulsion in which the individual grain surfaces were fogged (grain size: 0.06 micron, 1 mol % silver iodobromide emulsion) was so coated as to have a dry thickness of 0.8 micron and a silver coverage of 0.1 g/m$^2$.

In each of these layers, 1,4-bis(vinylsulfonylacetamido)ethane as a gelatin hardener and a surface active agent were additionally contained.

Samples IV-B to IV-P were prepared in the same manner as in Sample IV-$A_1$ or IV-$A_2$ except that Comparative Magenta Coupler (1) or (2) was replaced by an equimolar amount of each of Couplers (6), (8), (10), (17), (26), (28), (30), (31), (36), (37), (42), (44), (45), (49), and (51), respectively.

These Samples IV-A to IV-P were exposed through a neutral gray wedge for sensitometry and then subjected to reversal processing steps.

| Processing Steps | Time | Temperature |
|---|---|---|
| First Development | 6 min. | 38° C. |
| Washing | 2 min. | " |
| Reversal | 2 min. | " |
| Color Development | 6 min. | " |
| Adjustment | 2 min. | " |
| Bleaching | 6 min. | " |
| Fixing | 4 min. | " |
| Washing | 4 min. | " |
| Stabilization | 1 min. | Ordinary temp. |
| Drying | | |

Processing solutions having the compositions described below were employed.

| | |
|---|---|
| **First Developer** | |
| Water | 700 ml |
| Pentasodium nitrilo-N,N,N-trimethylenephosphate | 2 g |
| Sodium sulfite | 20 g |
| Hydroquinone monosulfonate | 30 g |
| Sodium carbonate (monohydrate) | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1% soln.) | 2 ml |
| Water to make | 1000 ml |
| **Reversing Solution** | |
| Water | 700 ml |
| Pentasodium nitrilo-N,N,N-trimethylenephosphate | 3 g |
| Stannous chloride (dihydrate) | 1 g |
| p-Aminophenol | 0.1 g |
| Sodium hydroxide | 8 g |
| Glacial acetic acid | 15 ml |
| Water to make | 1000 ml |
| **Color Developer** | |
| Water | 700 ml |
| Pentasodium nitrilo-N,N,N-trimethylenephosphate | 3 g |
| Sodium tertiary phosphate (dodecahydrate) | 36 g |
| Potassium bromide | 1 g |
| Potassium iodide (0.1% soln.) | 90 ml |
| Sodium hydroxide | 3 g |
| Citrazinic acid | 1.5 g |
| N-Ethyl-N-(β-methanesulfonamidoethyl)-3-methyl-4-aminoaniline sulfate | 11 g |
| 3,6-dithiaoctane-1,8-diol | 1 g |
| Water to make | 1000 ml |
| **Adjusting Solution** | |
| Water | 700 ml |
| Sodium sulfite | 12 g |
| Sodium ethylenediaminetetraacetate (dihydrate) | 8 g |
| Thioglycerine | 0.4 ml |
| Glacial acetic acid | 3 ml |
| Water to make | 1000 ml |
| **Bleaching Solution** | |
| Water | 800 ml |
| Sodium ethylenediaminetetraacetate (dihydrate) | 2 g |
| Ammonium ethylenediaminetetra-acetatoferrate(III) (dihydrate) | 120 g |
| Potassium bromide | 100 g |
| Water to make | 1000 ml |
| **Fixing Solution** | |
| Water | 800 ml |
| Sodium thiosulfate | 80.0 g |
| Sodium sulfite | 5.0 g |
| Sodium bisulfite | 5.0 g |
| Water to make | 1000 ml |
| **Stabilizing Solution** | |
| Water | 800 ml |
| Formaldehyde (37 wt % soln.) | 5.0 ml |
| Fuji Driwel (surface active agent, a product of Fuji Photo Film Co., Ltd.) | 5.0 ml |
| Water to make | 1000 ml |

The thus obtained sensitometric samples were examined for photographic characteristics, and the results obtained are shown in Table 10.

TABLE 10

| Sample | Coupler | Photographic Characteristics: Gradation (γ)* | Photographic Characteristics: Maximum Density** (Dm) |
|---|---|---|---|
| IV-$A_1$ | Comparative Coupler (1) | 2.34 | 2.60 |
| IV-$A_2$ | Comparative Coupler (2) | 2.32 | 2.58 |
| IV-B | (6) | 2.51 | 2.76 |
| IV-C | (8) | 2.52 | 2.77 |
| IV-D | (10) | 2.60 | 2.73 |
| IV-E | (17) | 2.55 | 2.72 |
| IV-F | (26) | 2.47 | 2.69 |
| IV-G | (28) | 2.48 | 2.68 |
| IV-H | (30) | 2.41 | 2.65 |
| IV-I | (31) | 2.49 | 2.67 |
| IV-J | (36) | 2.54 | 2.62 |
| IV-K | (37) | 2.53 | 2.63 |
| IV-L | (42) | 2.47 | 2.64 |
| IV-M | (44) | 2.51 | 2.66 |
| IV-N | (45) | 2.48 | 2.71 |
| IV-0 | (49) | 2.47 | 2.67 |
| IV-P | (51) | 2.45 | 2.65 |

*The gradation (γ) is a slope of the characteristic curve in the straight line portion corresponding to the density range of 0.6 to 2.0.
**The maximum density means a maximum density of magenta dye image.

As can be seen from the data shown in Table 10, Samples IV-B to IV-P in which the couplers of the present invention are employed had improved gradation (γ) and produced high color density of the developed image.

EXAMPLE 8

On a triacetyl cellulose film support were coated the layers described below in this order to prepare multilayered multicolor photographic materials (Samples V-$A_1$ and V-$A_2$).

First Layer: Antihalation Layer

A gelatin layer containing black colloidal silver.

Second Layer: Interlayer

A gelatin layer containing an emulsion dispersion of 2,5-di-t-octylhydroquinone.

Third Layer: First Red-sensitive Emulsion Layer

A layer containing a silver iodobromide emulsion (having an iodide content of 5 mol % and a silver coverage of 1.6 g $m^2$), $4.5\times10^{-4}$ mole/mole silver of Sensitizing Dye I, $1.5\times10^{-4}$ mole/mole silver of Sensitizing Dye II, 0.04 mole/mole silver of Coupler EX-1, 0.003 mole/mole silver of Coupler EX-3, and 0.0006 mole/mole silver of Coupler EX-9.

Fourth Layer: Second Red-sensitive Emulsion Layer

A layer containing a silver iodobromide emulsion (having an iodide content of 10 mol % and a silver coverage of 1.4 g $m^2$), $3\times10^{-4}$ mole/mole silver of Sensitizing Dye I, $1\times10^{-4}$ mole/mole silver of Sensitizing Dye II, 0.002 mole/mole silver of Coupler EX-1, 0.02 mole/mole silver of Coupler EX-2, and 0.0016 mole/mole silver of Coupler EX-3.

Fifth Layer: Interlayer

The same layer as the second layer.

Sixth Layer: First Green-sensitive Emulsion Layer

A layer containing a silver iodobromide emulsion (having an iodide content of 4 mol % and a silver coverage of 1.2 g/$m^2$), $5\times10^{-4}$ mole/mole silver of Sensitizing Dye III, $2\times10^{-4}$ mole/mole silver of Sensitizing Dye IV, and 0.05 mole/mole silver of Comparative Magenta Coupler (a) or (2).

Seventh Layer: Second Green-sensitive Emulsion Layer

A layer containing a silver iodobromide emulsion (having an iodide content of 4 mol % and a silver coverage of 1.3 g $m^2$), $3\times10^{-4}$ mole/mole silver of Sensitizing Dye III, $1.2\times10^{-4}$ mole/mole silver of Sensitizing Dye IV, and 0.017 mole/mole silver of Comparative Magenta Coupler (1) or (2).

Eighth Layer: Yellow Filter Layer

A gelatin layer containing an emulsion dispersion prepared by emulsifying and dispersing yellow colloidal silver and 2,5-di-t-octylhydroquinone into a gelatin aqueous solution.

Ninth Layer: First Blue-sensitive Emulsion Layer

A layer containing a silver iodobromide emulsion (having an iodide content of 6 mol % and a silver coverage of 0.7 g/$m^2$), 0.25 mole/mole silver of Coupler EX-4, and 0.015 mole/mole silver of Coupler EX-5.

Tenth Layer: Second Blue-sensitive Emulsion Layer

A layer containing a silver iodobromide emulsion (having an iodide content of 6 mol % and a silver coverage of 0.6 g/$m^2$), and 0.06 mole/mole silver of Coupler EX-4.

Eleventh Layer: First Protective Layer

A gelatin layer containing silver iodobromide (having an iodide content of 1 mol % and a mean grain size of 0.07 micron and a silver coverage of 0.5 g/$m^2$), and an emulsion dispersion of UV Light Absorbent UV-1.

Twelfth Layer: Second Protective Layer

A gelatin layer containing polymethyl methacrylate particles (having a diameter of about 1.5 microns).

In addition to the above-described ingredients, Gelatin Hardener H-1 and a surface active agent were incorporated in each of the foregoing layers.

Structural formulae of the ingredients employed in the foregoing layers are illustrated below.

Coupler EX-1

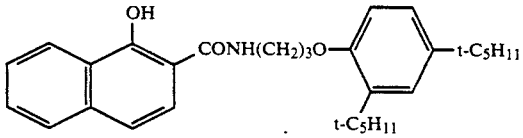

Coupler EX-2

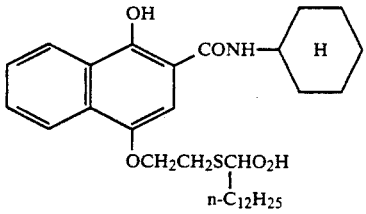

Coupler EX-3

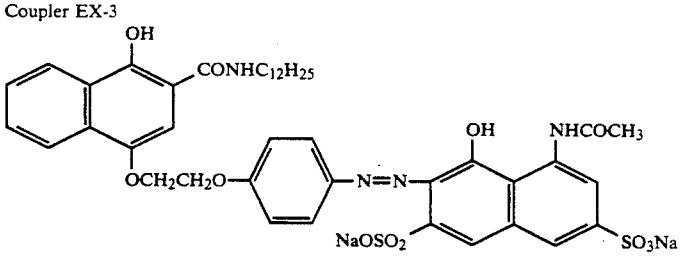

Coupler EX-4

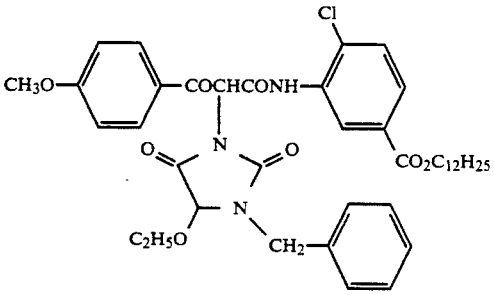

-continued
Coupler EX-5
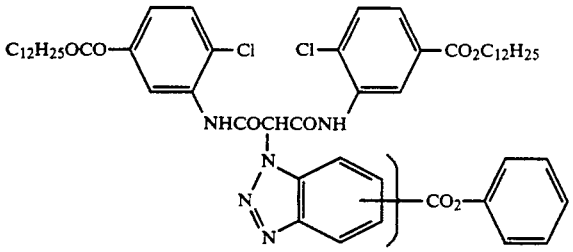
Coupler EX-6
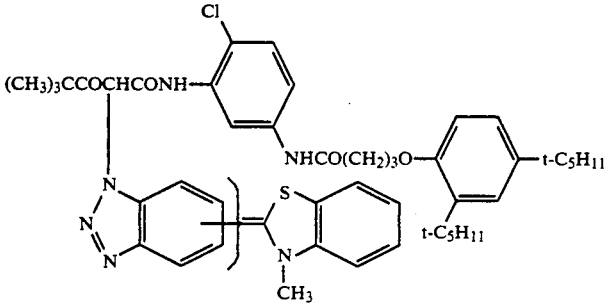
Comparative Magenta Coupler (1) (in sample V-$A_1$)
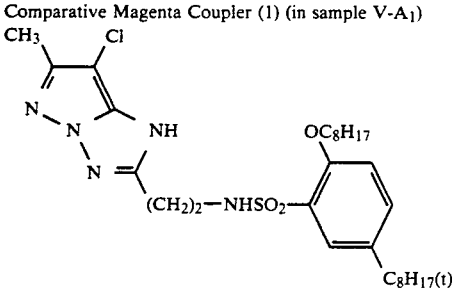
Comparative Magenta Coupler (2) (in sample V-$A_2$)
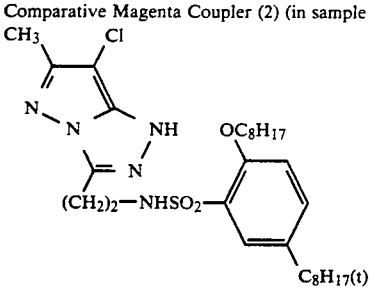
(Comparative Magenta Couplers (1) and (2) are described in European Patent 176,804A.)
H-1
$(CH_2{=}CHSO_2CH_2CONHCH_2)_2$
UV-1
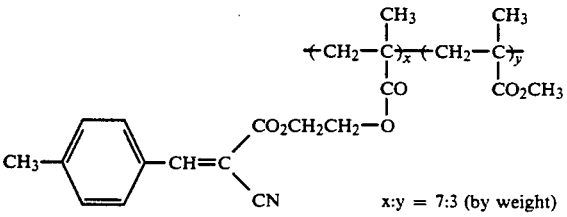
x:y = 7:3 (by weight)
Sensitizing Dye I -continued

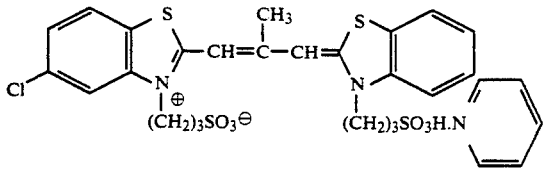

Sensitizing Dye II

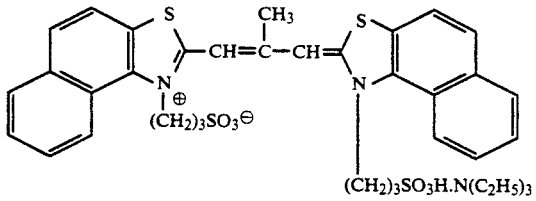

Sensitizing Dye III

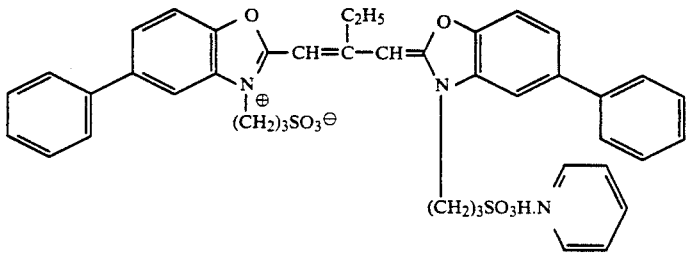

Sensitizing Dye IV

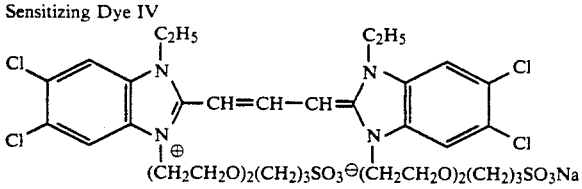

Samples V-B to V-P were prepared in the same manner as in Sample V-$A_1$ or V-$A_2$ except that Comparative Magenta Coupler (1) or (2) was replaced by an equimolar amount of each of Couplers (6), (8), (10), (17), (26), (28), (30), (31), (36), (37), (42), (44), (45), (49), and (51), respectively. These Samples V-A to V-P were subjected to wedge exposure in a conventional manner and then processed according to the following processing steps using processing solutions having the formulations described below.

The photographic processing employed herein included the following steps and was carried out at a temperature of 38° C.

| | |
|---|---|
| 1. Color Development | 3 min. and 15 sec. |
| 2. Bleaching | 6 min. and 30 sec. |
| 3. Washing | 3 min. and 15 sec. |
| 4. Fixing | 6 min. and 30 sec. |
| 5. Washing | 3 min. and 15 sec. |
| 6. Stabilization | 3 min. and 15 sec. |

Compositions of the processing solutions used were as follows.

| | |
|---|---|
| (Color Developer) | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |

-continued

| | |
|---|---|
| 4-(N-Ethyl-N-β-hydroxyethylamino)-2-methylaniline sulfate | 4.5 g |
| Water to make | 1000 ml |
| (Bleaching Solution) | |
| Ammonium bromide | 160.0 g |
| Aqueous ammonia (28%) | 25.0 ml |
| Sodium ethylenediaminetetraacetato-ferrate(III) | 130.0 g |
| Glacial acetic acid | 14.0 ml |
| Water to make | 1000 ml |
| (Fixing Solution) | |
| Sodium tetrapolyphosphate | 2.0 g |
| Sodium sulfite | 4.0 g |
| Ammonium thiosulfate (70% soln.) | 175.0 ml |
| Sodium bisulfite | 4.6 g |
| Water to make | 1000 ml |
| (Stabilizing Solution) | |
| Formaldehyde (aq. soln.) | 8.0 ml |
| Water to make | 1000 ml |

The thus obtained sensitometric samples were examined for photographic characteristics, and the results obtained are shown in Table 11.

TABLE 11

| | Photographic Characteristics | | |
|---|---|---|---|
| Sample | Sensitivity | Gradation (γ) | Color Density of Developed Image** |
| V-$A_1$ | 100 | 0.60 | 2.00 |
| V-$A_2$ | 101 | 0.61 | 2.01 |
| V-B | 107 | 0.73 | 2.28 |
| V-C | 111 | 0.77 | 2.30 |

TABLE 11-continued

| Sample | Photographic Characteristics | | |
|---|---|---|---|
| | Sensitivity | Gradation (γ) | Color Density of Developed Image** |
| V-D | 106 | 0.71 | 2.26 |
| V-E | 105 | 0.68 | 2.27 |
| V-F | 110 | 0.69 | 2.31 |
| V-G | 107 | 0.72 | 2.30 |
| V-H | 104 | 0.73 | 2.22 |
| V-I | 105 | 0.75 | 2.25 |
| V-J | 108 | 0.72 | 2.27 |
| V-K | 105 | 0.65 | 2.24 |
| V-L | 104 | 0.63 | 2.26 |
| V-M | 107 | 0.68 | 2.28 |
| V-N | 105 | 0.67 | 2.30 |
| V-O | 108 | 0.66 | 2.29 |
| V-P | 104 | 0.65 | 2.25 |

*The sensitivity is expressed in terms of a relative value of a reciprocal of an exposure required for providing a density of fog +0.2, taking the sensitivity of Sample V-$A_1$ as 100.

**The color density is represented by a magenta color density corresponding to the exposure (log E) under which Sample V-$A_1$ acquired the magenta color density, D = 2.0.

As can be seen from the data shown in Table 11, both the sensitivity and gradation(γ) were improved in Samples V-B to V-P wherein the couplers of the present invention are employed, and high color density of the developed image was also obtained therein.

When a pyrazoloazole magenta coupler according to the present invention is used in combination with a color image stabilizer represented by the formula

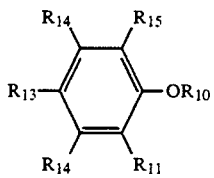

as described hereinbefore, it is also found that the degree of occurrence of yellowing (i.e., formation of yellow stain due to heat) in the white background area during image preservation is significantly reduced, i.e., improved stain resistance is provided.

This effect is evidenced by the following experiments, based on Examples 4 and 6 as described above.

(1) A comparison between color image stabilizer (j) as was used in Example 4 and each of color image stabilizers (B), (C) and (D), all of which are described in literature references cited hereinbefore in the specification and identified specifically below, was made by replacing the former with an equimolar amount of the latter. The results obtained are shown in Table 12.

TABLE 12

| Sample | Yellow Stain ($\Delta D_B$)* Kind of Color Image Stabilizer | | | | |
|---|---|---|---|---|---|
| | Nil | (J) | (B) | (C) | (D) |
| II-$A_1$ | 0.08 | 0.07 | 0.08 | 0.07 | 0.08 |
| II-$A_2$ | 0.09 | 0.08 | 0.08 | 0.09 | 0.08 |
| II-B | 0.22 | 0.09 | 0.10 | 0.12 | 0.11 |
| II-C | 0.23 | 0.10 | 0.11 | 0.12 | 0.11 |
| II-D | 0.25 | 0.12 | 0.11 | 0.13 | 0.13 |
| II-E | 0.24 | 0.12 | 0.12 | 0.13 | 0.12 |
| II-F | 0.20 | 0.10 | 0.10 | 0.11 | 0.11 |
| II-G | 0.19 | 0.11 | 0.10 | 0.10 | 0.11 |
| II-H | 0.21 | 0.09 | 0.08 | 0.09 | 0.10 |
| II-I | 0.23 | 0.11 | 0.10 | 0.11 | 0.12 |
| II-J | 0.24 | 0.12 | 0.11 | 0.09 | 0.12 |
| II-K | 0.25 | 0.12 | 0.11 | 0.11 | 0.12 |
| II L | 0.22 | 0.11 | 0.12 | 0.13 | 0.11 |
| II-M | 0.21 | 0.10 | 0.10 | 0.11 | 0.10 |

TABLE 12-continued

| Sample | Yellow Stain ($\Delta D_B$)* Kind of Color Image Stabilizer | | | | |
|---|---|---|---|---|---|
| | Nil | (J) | (B) | (C) | (D) |
| II-N | 0.26 | 0.12 | 0.13 | 0.10 | 0.10 |

*The increase in yellow density when preserved at 70° C. for 2 months is expressed by "$\Delta D_B$". The smaller the $\Delta D_B$ value, the less the occurrence of stain.

Color Image Stabilizer (J)

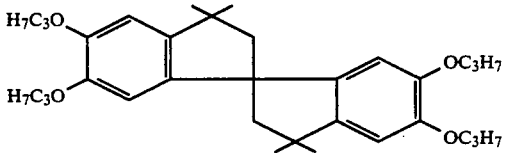

Color Image Stabilizer (B)

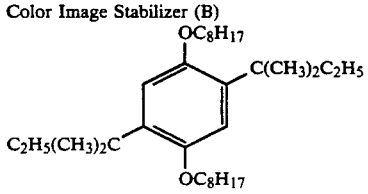

(color image stabilizer described in U.S. Pat. No. 4,254,216)

Color Image Stabilizer (C)

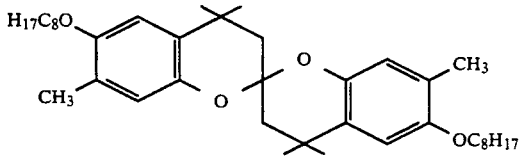

(color image stabilizer described in JP-A-53-20327)

Color Image Stabilizer (D)

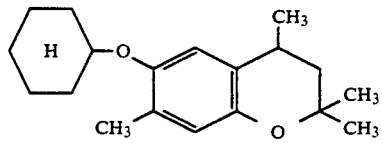

(color image stabilizer described in JP-A-53-17729)

As is clear from Table 12, in Samples II-$A_1$ and II-$A_2$, wherein comparative couplers were used, substantially no decrease in the yellow stain due to heat was observed upon the incorporation of the color image stabilizers; in contrast, in Samples II-B to II-N, utilizing couplers in accordance with the present invention, the inhibition of the occurrence of yellow stain due to the particular combination of coupler and color image stabilizer in accordance with the present invention is quite evident.

(2) Similar effects were found in the case of samples based on Example 6. The results are shown in Table 13 below.

TABLE 13

| Sample | Coupler | Yellow Stain ($\Delta D_B$)* Kind of Color Image Stabilizer | | | | |
|---|---|---|---|---|---|---|
| | | Nil | (J) | (B) | (C) | (D) |
| III-$A_1$ | Comparative Coupler (1) | 0.08 | 0.07 | 0.08 | 0.08 | 0.07 |
| III-$A_2$ | Comparative Coupler (2) | 0.08 | 0.07 | 0.07 | 0.08 | 0.07 |
| III-B | (6) | 0.23 | 0.08 | 0.09 | 0.10 | 0.11 |
| III-C | (8) | 0.22 | 0.10 | 0.10 | 0.11 | 0.10 |
| III-D | (10) | 0.24 | 0.11 | 0.12 | 0.12 | 0.11 |
| III E | (17) | 0.25 | 0.12 | 0.12 | 0.12 | 0.13 |

TABLE 13-continued

| Sample | Coupler | Yellow Stain ($\Delta D_B$)* Kind of Color Image Stabilizer | | | | |
|---|---|---|---|---|---|---|
| | | Nil | (J) | (B) | (C) | (D) |
| III-F | (26) | 0.26 | 0.13 | 0.12 | 0.11 | 0.11 |
| III-G | (28) | 0.25 | 0.10 | 0.12 | 0.12 | 0.10 |
| III-H | (30) | 0.24 | 0.11 | 0.12 | 0.12 | 0.12 |
| III-I | (31) | 0.23 | 0.11 | 0.11 | 0.10 | 0.10 |
| III-J | (36) | 0.24 | 0.12 | 0.11 | 0.10 | 0.10 |
| III-K | (37) | 0.25 | 0.10 | 0.12 | 0.13 | 0.11 |
| III-L | (42) | 0.23 | 0.11 | 0.11 | 0.12 | 0.12 |
| III-M | (44) | 0.23 | 0.13 | 0.13 | 0.11 | 0.10 |
| III-N | (45) | 0.24 | 0.10 | 0.15 | 0.13 | 0.11 |

From the results described above, it has been proved that in the silver salt color photography, the couplers of the present invention have less dependence of sensitivity, gradation and maximum density upon color development time and can exhibit photographic characteristics with smaller fluctuation by short-time development as compared with the conventional couplers having an alkyl group at the 6-position, and furthermore in combination with a color image stabilizer according to the invention, improved resistance to yellow stain formation due to heat is provided. As the couplers of the present invention possesses higher activity and higher color-forming efficiency as compared with the conventional pyrazoloazole couplers, they are advantageous in designing photographic materials. Thus, the couplers of the present invention are found to have excellent properties.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon a silver halide emulsion layer containing at least one coupler represented by the following formulae (I) and (II):

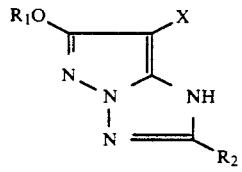

(I)

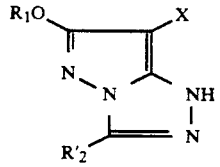

(II)

wherein $R_1$ represents an alkyl group, an aryl group or a heterocyclic group; $R_2$ or $R'_2$ represents an alkyl group or an aryl group; and X represents a coupling split-off group linked through a nitrogen atom or a sulfur atom.

2. The photographic material as in claim 1, wherein $R_2$ or $R'_2$ is a substituted alkyl group or a substituted aryl group.

3. The photographic material as in claim 2, wherein $R_2$ or $R'_2$ is a substituted alkyl group.

4. The photographic material as in claim 1, wherein a monomer having the moiety represented by the formula (I) or (II) forms a copolymer together with a non-color-forming ethylenic monomer which is not coupled with an oxidation product of an aromatic primary amine developing agent.

5. The photographic material as in claim 1, wherein the coupler represented by the formula (I) or (II) is present in an amount of from $2\times10^{-3}$ mole to $5\times10^{-1}$ mole per mole of the silver halide.

6. The photographic material as in claim 5, wherein the coupler represented by the formula (I) or (II) is present in an amount of from $1\times10^{-2}$ mole to $5\times10^{-1}$ mole per mole of the silver halide.

* * * * *